US009982480B2

(12) United States Patent
Manning

(10) Patent No.: US 9,982,480 B2
(45) Date of Patent: May 29, 2018

(54) COLLAPSIBLE WALL

(71) Applicant: Advanced Equipment Corporation, Fullerton, CA (US)

(72) Inventor: Frank V. Manning, Moreno Valley, CA (US)

(73) Assignee: Advanced Equipment Corporation, Fullerton, CA (US)

( * ) Notice: Subject to any disclaimer, the term of this patent is extended or adjusted under 35 U.S.C. 154(b) by 671 days.

(21) Appl. No.: 14/599,281

(22) Filed: Jan. 16, 2015

(65) Prior Publication Data

US 2015/0240553 A1 Aug. 27, 2015

Related U.S. Application Data

(60) Provisional application No. 61/943,216, filed on Feb. 21, 2014.

(51) Int. Cl.

| | |
|---|---|
| ***E06B 3/94*** | (2006.01) |
| ***E06B 9/06*** | (2006.01) |
| ***E06B 5/20*** | (2006.01) |
| ***E06B 3/92*** | (2006.01) |
| ***E06B 3/01*** | (2006.01) |

(52) U.S. Cl.

CPC ..... *E06B 9/0638* (2013.01); *E06B 3/01* (2013.01); *E06B 3/928* (2013.01); *E06B 3/94* (2013.01); *E06B 5/20* (2013.01)

(58) Field of Classification Search

CPC . E06B 5/20; E06B 3/01; E06B 9/0638; E06B 3/927; E06B 3/94; E06B 3/928; E05D 15/262

USPC ..... 160/84.08, 84.09, 84.11, 188, 189

See application file for complete search history.

(56) References Cited

U.S. PATENT DOCUMENTS

| | | | | |
|---|---|---|---|---|
| 1,965,262 A | | 7/1934 | Seregi | |
| 3,344,837 A | | 10/1967 | Young | |
| 3,750,994 A | * | 8/1973 | Bieschke | G03B 21/58 160/24 |
| 4,027,714 A | * | 6/1977 | Dixon | E06B 3/94 16/225 |
| 4,186,534 A | * | 2/1980 | Le Coze | E04B 2/821 52/241 |
| 4,303,117 A | | 12/1981 | Lindbergh | |
| 4,724,884 A | * | 2/1988 | Weem | E06B 3/94 160/84.08 |
| 4,763,712 A | | 8/1988 | van der Klaauw | |
| 4,867,221 A | * | 9/1989 | Dixon | E06B 3/94 160/199 |

(Continued)

*Primary Examiner* — Justin B Rephann

(74) *Attorney, Agent, or Firm* — Barry IP Law

(57) ABSTRACT

A collapsible wall including a support frame and a first series of panels configured to suspend from the support frame with at least one pair of adjacent panels pivotally connected to each other. A second series of panels are configured to suspend from the support frame opposite the first series of panels and include at least one pair of adjacent panels pivotally connected to each other. A bottom sill opposite the support frame is pivotally connected to a bottom portion of the first series of panels and to a bottom portion of the second series of panels. A motor assembly is mounted on the support frame and configured to raise or lower at least one lifting element to raise or lower the bottom sill to collapse or extend the panels in the first and second series of panels.

36 Claims, 20 Drawing Sheets

(56) References Cited

U.S. PATENT DOCUMENTS 5,062,464 A * 11/1991 Peterson ..... E06B 3/94 160/138
5,163,494 A * 11/1992 MacNeil ..... E06B 3/928 160/188
5,283,993 A * 2/1994 Sprung, Sr. ..... E04H 15/38 135/117
5,339,881 A * 8/1994 Owens ..... E06B 7/18 160/40
5,467,559 A * 11/1995 Owens ..... E06B 7/2316 160/40
6,145,568 A * 11/2000 Lundstrom ..... E06B 9/0692 160/189
6,267,169 B1 * 7/2001 McDonald ..... E05D 15/262 160/193
6,388,412 B1 * 5/2002 Reed ..... E06B 9/68 318/266
6,808,000 B1 * 10/2004 Peterson ..... E06B 3/928 160/138
7,156,142 B2 1/2007 Peterson
7,931,067 B2 * 4/2011 Goodman ..... E05D 15/26 16/365
8,033,068 B2 * 10/2011 Luttmann ..... E04B 2/827 160/40
8,327,905 B2 * 12/2012 McDonald ..... E06B 3/483 160/213
8,336,257 B2 * 12/2012 McDonald ..... E04B 1/043 49/303
8,468,751 B2 * 6/2013 Williams ..... E04B 2/827 160/201
9,045,935 B2 * 6/2015 McDonald ..... E06B 3/483
2005/0211395 A1 * 9/2005 Peterson ..... E06B 3/928 160/193
2010/0024992 A1 * 2/2010 Cloninger ..... A62C 2/10 160/311
2010/0126543 A1 * 5/2010 Cutler ..... A01G 9/227 135/117
2011/0023366 A1 * 2/2011 McDonald ..... E06B 9/0638 49/316
2012/0080152 A1 * 4/2012 McDonald ..... E06B 3/483 160/84.08
2012/0285090 A1 * 11/2012 Williams ..... E04B 2/827 49/73.1
2013/0019534 A1 * 1/2013 Ressel ..... E05F 15/603 49/358
2013/0068398 A1 * 3/2013 Wills ..... E06B 9/42 160/26
2014/0250787 A1 * 9/2014 Olmsted ..... E05F 15/70 49/31
2014/0332172 A1 * 11/2014 Hsieh ..... E06B 9/84 160/133

* cited by examiner

COLLAPSIBLE WALL

CROSS REFERENCE TO RELATED APPLICATION

This application claims the benefit of U.S. Provisional Application No. 61/943,216, filed on Feb. 21, 2014, which is hereby incorporated by reference in its entirety.

FIELD

The present disclosure relates to partitioning a room. More particularly, the present disclosure relates to a collapsible wall for partitioning a room.

BACKGROUND

Partitions are often used to divide large rooms such as theaters, conference rooms, convention halls or gymnasiums. Typical partitions can include panels or curtains that hang from an overhead track and slide or unfold horizontally along the track from a storage position to partition a room. Such partitions require floor space for storage and often do not adequately provide for soundproofing between the spaces on opposite sides of the partition.

More sophisticated partitions may feature vertically folding panels, but such systems generally do not provide sufficient soundproofing, can be difficult to install, and do not compensate for changes in the building structure, for example, due to thermal changes or changes in the loading of the building structure.

BRIEF DESCRIPTION OF THE DRAWINGS

The features and advantages of the embodiments of the present disclosure will become more apparent from the detailed description set forth below when taken in conjunction with the drawings. The drawings and the associated descriptions are provided to illustrate embodiments of the disclosure and not to limit the scope of what is claimed.

DETAILED DESCRIPTION

In the following detailed description, numerous specific details are set forth to provide a full understanding of the present disclosure. It will be apparent, however, to one of ordinary skill in the art that the various embodiments disclosed may be practiced without some of these specific details. In other instances, well-known structures and techniques have not been shown in detail to avoid unnecessarily obscuring the various embodiments.

Figure 1:
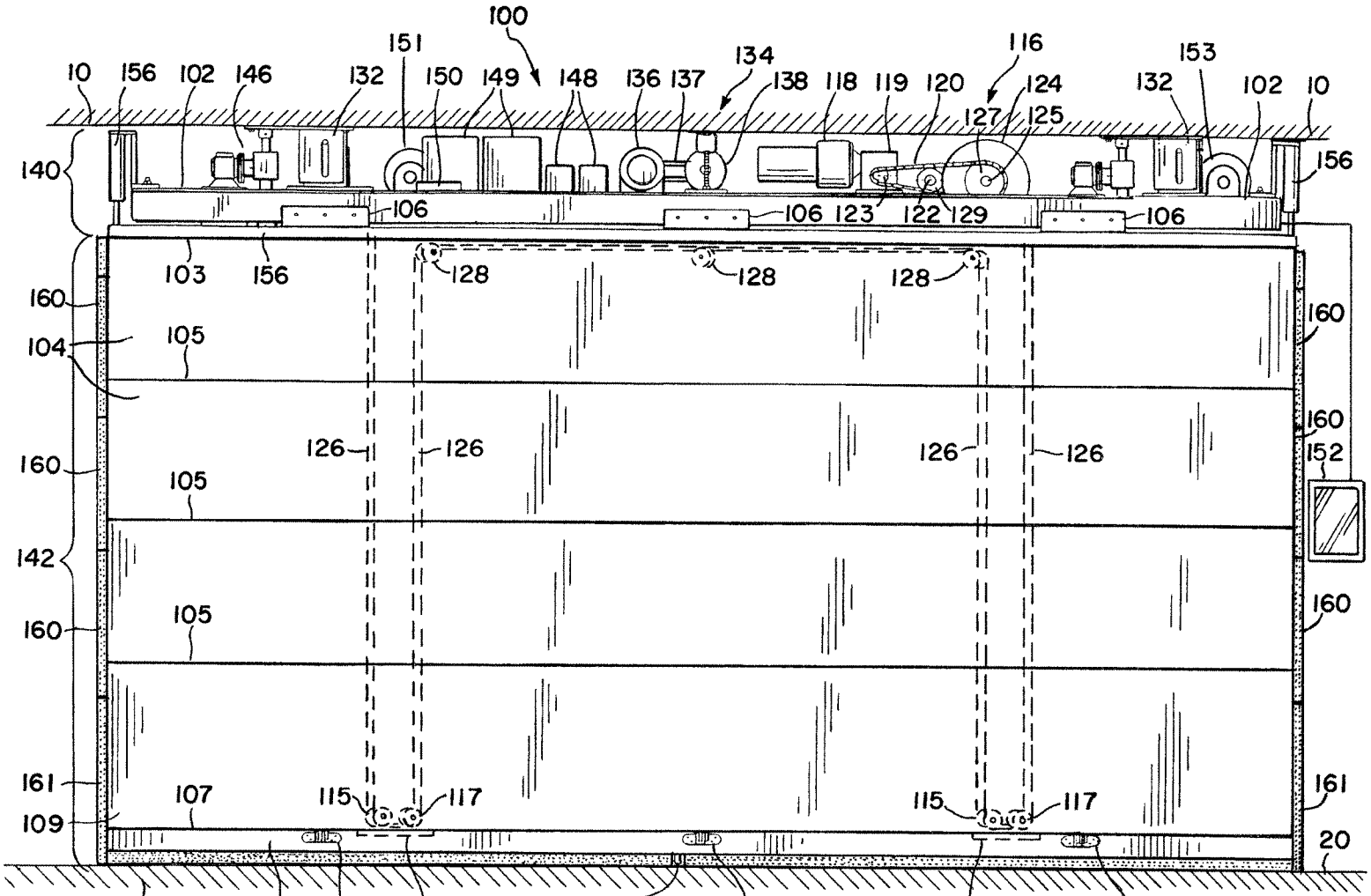
FIG. 1 depicts a side view of a collapsible wall in a fully extended state according to an embodiment.

FIG. 1 shows a side view of collapsible wall 100 according to an embodiment with collapsible wall 100 in a fully extended and locked state. As shown in FIG. 1, collapsible wall 100 includes support frame 102 constructed to suspend from building structure 10. Support frame 102 also provides for mounting of various electrical and mechanical components used in the operation of collapsible wall 100 as discussed in more detail below.

Support frame 102 is suspended from building structure 10 via screw jack assemblies 146 which are mounted on support frame 102 and connected to building structure 10. Screw jack assemblies 146 provide compensation for displacements or irregularities in building structure 10 or building floor 20. Such displacements and irregularities may, for example, result from changes in loading of building structure 10 (e.g., from an additional load on a roof such as a snow load or an additional load on a floor above building structure 10), thermal expansion or contraction of the building, or from construction irregularities (e.g., if building structure 10 or floor 20 is not level). These displacements and irregularities can be especially significant for larger sizes of collapsible wall 100 where relatively small changes can result in large displacements at distant portions of collapsible wall 100. In other embodiments, a different type of actuator instead of a screw jack may be mounted on support frame 102 to connect support frame 102 to building structure 10. In addition, a different number of actuators may be used to compensate for displacements or irregularities in building structure 10 or building floor 20.

In the embodiment of FIG. 1, controller 148 controls screw jack assemblies 146 to raise or lower portions of support frame 102 to mitigate displacements and irregularities. Controller 148 can include a Programmable Logic Controller (PLC) or a microprocessor controller that executes computer readable instructions stored in a memory of controller 148 to control operation of collapsible wall 100.

In the example of FIG. 1, controller 148 is electrically connected to floor contact sensor 144, which can include a spring loaded probe that moves up and down as collapsible wall 100 moves in relation to building floor 20 with collapsible wall 100 in the fully extended state. If the probe of floor contact sensor 144 moves outside of a predetermined range, controller 148 is alerted that the clearance between bottom sill 110 and building floor 20 is too large or too small. In response, controller 148 controls screw jack assemblies 146 to raise or lower collapsible wall 100 until the clearance between bottom sill 110 and building floor 20 is within the predetermined range. In other embodiments, collapsible wall 100 may include multiple floor contact sensors such that controller 148 can control screw jack assemblies 146 based on inputs from multiple floor contact sensors.

The predetermined range can be based on a level of compression of bottom seals 154 along the underside lengths of bottom sill 110. In this regard, bottom seal 154 includes a compressible gasket that serves as an acoustic seal between building floor 20 and bottom sill 110 when compressed between building floor 20 and bottom sill 110.

In one example, an increase in ambient temperature may cause a building to expand such that floor contact sensor 144 no longer contacts building floor 20 when collapsible wall 100 is in a fully extended state. Controller 148 may detect that collapsible wall 100 is not in contact with building floor 20 from an input received from floor contact sensor 144 when collapsible wall 100 is in the fully extended state. In response, controller 148 can adjust screw jack assemblies 146 to lower support frame 102 until an input from floor contact sensor 144 indicates that the clearance between building floor 20 and bottom sill 110 is within the predetermined range.

Controller 148 is also electrically connected to level sensor 150 shown in FIG. 1, which is mounted on support frame 102 and provides controller 148 with an input indicating whether support frame 102 is substantially horizontal (e.g., within one degree of horizontal). For example, uneven loading of a floor above building structure 10 may result in one portion of building structure 10 being lower than another portion of building structure 10. Controller 148 may detect this change in building structure 10 from an input received from level sensor 150 and may adjust an appropriate screw jack assembly 146 until the input from level sensor 150 is within a predetermined range.

Although the embodiment of FIG. 1 depicts two screw jack assemblies 146, other embodiments can include more screw jack assemblies. In yet other embodiments, collapsible wall 100 may not include any screw jack assemblies 146 and may instead only include fixed mount assemblies for mounting support frame 102 to building structure 10. Such fixed mount assemblies can include, for example, threaded rods connected to building structure 10 and support frame 102.

If screw jack assemblies 146 are used, sway plates 132 can be used to limit rotation of support frame 102 about its longitudinal axis while allowing for support frame 102 to move up and down with relation to building structure 10. As shown in FIG. 1, sway plates 132 can include a pair of parallel plates each mounted on support frame 102 or building structure 10, respectively, and allowed to move vertically in relation to a third plate bracketed by the pair of parallel plates.

As shown in FIG. 1, motor assembly 116 is also mounted on support frame 102. Motor assembly 116 lowers and raises lifting elements 114 to lower and raise bottom sill 110. In the embodiment of FIG. 1, collapsible wall 100 includes two lifting elements 114 in the form of lifting plates that are arranged to engage or contact bottom sill 110 so as to appropriately distribute a load of collapsible wall 100 when raising and lowering collapsible wall 100. In other embodiments, lifting elements 114 can include sheaves mounted on or in contact with bottom sill 110. The location of lifting elements 114 along bottom sill 110 can be determined to distribute the lifting force along bottom sill 110.

Other embodiments may include additional lifting elements 114 with additional support pulleys 128 mounted on support frame 102 to keep the load on lift cables 126 within safety limits and to more uniformly distribute the lifting load along bottom sill 110. For example, a longer or taller collapsible wall than that of FIG. 1 may include a third lifting element positioned along bottom sill 110 and additional support pulleys 128 mounted on support frame 102 to distribute the lifting load of the collapsible wall among three lifting elements 114.

Figure 6:
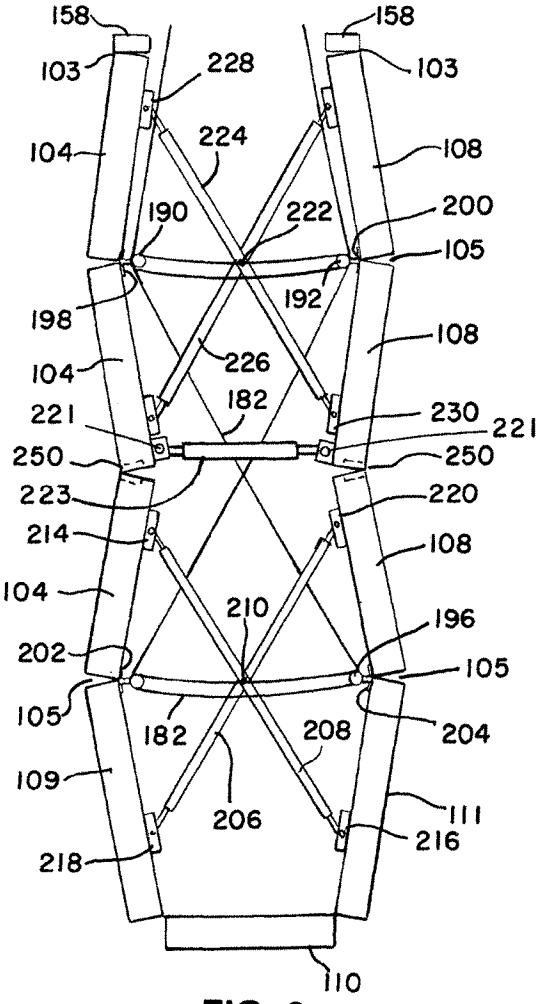
FIG. 6 depicts an end view of a collapsible wall in a fully extended state with unlocked panels according to an embodiment.

Motor assembly 116 includes lift motor 118, gear reducer 119, roller chain 120, emergency brake shaft 122, drive shaft sprocket 123, lift cable drums 124, drum shaft 125, drum shaft sprocket 127, and emergency brake shaft gear 129. In some implementations, roller chain 120 can be a double strand roller chain. In addition, and as shown in FIG. 6, motor assembly 116 further includes emergency brake 240, and drum shaft mounts 242 and 243. Although the embodiment of FIG. 1 shows a single motor assembly 116, other embodiments may include multiple motor assemblies 116 for redundancy or to distribute the work of raising and lowering collapsible wall 100.

In operation, controller 148 controls lift motor 118 to drive gear reducer 119 to rotate drum shaft 125 and lift cable drums 124 via drive shaft sprocket 123 and roller chain 120. In one implementation, the operation of motor assembly 116 can be controlled with user interface 152 which is electrically connected to controller 148. User interface 152 can be, for example, a touch screen display or include push buttons with or without a display for controlling operation of collapsible wall 100. In some implementations, user interface 152 can also be used for maintenance or testing of collapsible wall 100.

In the example of FIG. 1, controller 148 may control lift motor 118 in a forward or reverse direction based on an input from user interface 152 to raise or lower the panels of collapsible wall 100. Lift motor 118 can employ a magnetic brake to lock lift cable drums 124 in place. Horsepower for lift motor 118 can be sized to handle a weight of the panels and bottom sill 110 with a safety factor. In this regard, the panels and bottom sill 110 can be formed of, for example, various metals, plastics, fabrics, fiberglass, or a combination thereof. The panels may also have mostly hollow interiors. In one example, lift motor 118 is a ¾ horsepower motor and can be powered by either a 120 or 220 volt building power supply. In addition, drive shaft sprocket 123 and drum shaft sprocket 127 can be sized for a particular lift speed and lift motor efficiency.

When raising collapsible wall 100, lift cable drums 124 are rotated so as to wind lift cables 126 onto lift cable drums 124 and pull lift cables 126 through lifting sheaves 115 and 117 of lifting elements 114. Lift cables 126 are connected to support frame 102 via cable support 130 (shown in FIG. 2) so that the winding of lift cables 126 onto lift cable drums 124 pulls lifting elements 114 up toward support frame 102.

Figure 2:
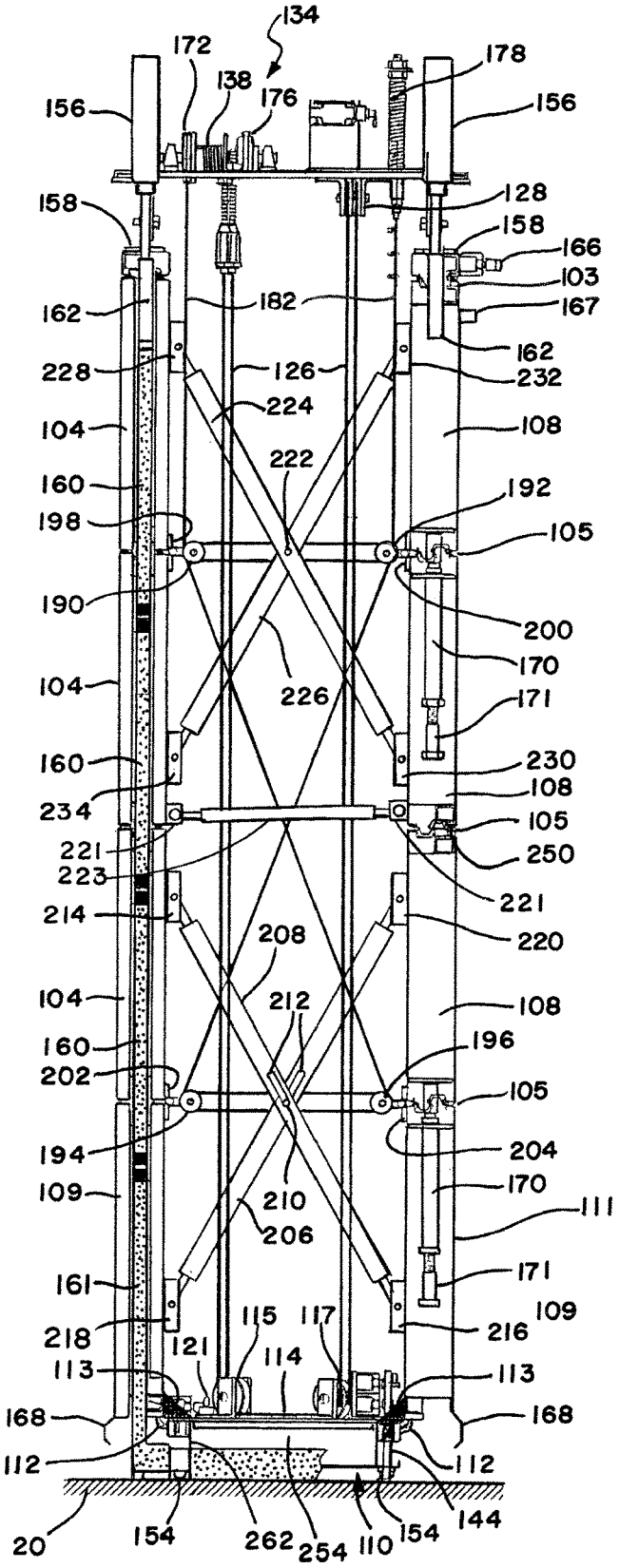
FIG. 2 depicts an end view of a collapsible wall in a fully extended state with locked panels according to an embodiment.

In the examples of FIGS. 1 and 2, collapsible wall 100 is raised and lowered using two lift cables 126 to distribute the load and to provide redundancy in case a cable breaks with either lift cable being capable of handling the lifting load of collapsible wall 100. In other embodiments, such as in FIGS. 19 and 20, a different number of lift cables 126 may be used.

Motor assembly 116 can also include a speed sensor (not shown) such as at one of drum shaft mounts 242 or 243 shown in FIG. 6 so as to allow controller 148 to determine when to activate emergency brake 240. Drum shaft 125 can be equipped with a spur gear (not shown) that drives emergency brake shaft gear 129 mounted on emergency brake shaft 122. If an input from the speed sensor indicates that the angular velocity of drum shaft 125 exceeds a predetermined threshold, controller 148 activates emergency brake 240 to stop the lowering of collapsible wall 100. For example, if there is a break in roller chain 120, an input from the speed sensor can alert controller 148 which activates emergency brake 240 to stop bottom sill 110 from dropping. Other embodiments can include multiple emergency brakes 240 based on the weight of the panels and the bottom sill.

An input from the speed sensor may also be used as feedback to controller 148 when controlling lift motor 118 to maintain, decelerate or accelerate a rate of lowering or raising bottom sill 110.

Figure 10:
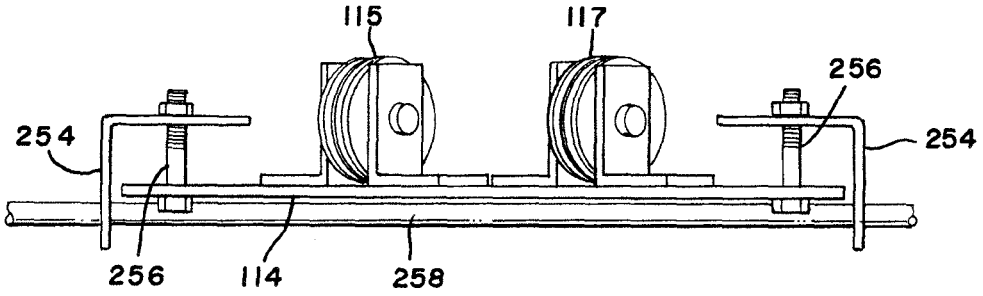
FIG. 10 depicts a side view of a bottom sill and a lifting element in a lowered state according to an embodiment.

In one implementation, as collapsible wall 100 reaches a fully extended state, controller 148 uses an input from extended state switch 121 (shown in FIG. 2 on bottom sill 110) to control lift motor 118 to decelerate and/or stop the lowering of bottom sill 110. Extended state switch 121 is located on bottom sill 110 and is electrically connected to controller 148. After bottom sill 110 contacts building floor 20, lifting element 114 begins to disengage from bottom sill 110 (as shown in FIG. 10) so that extended state switch 121 is no longer in contact with lifting element 114. Controller 148 can use an input from extended state switch 121 indicating that lifting element 114 is no longer in contact with extended state switch 121 to initiate deceleration and/or stopping of lift motor 118. In other embodiments, floor contact sensor 144 or a counter (not shown) configured to count revolutions of drum shaft 125 can be used to initiate deceleration and/or stopping of lift motor 118. The extended state deceleration for lift motor 118 can be set as a default in a memory of controller 148 or programmed in a memory of controller 148 after installation (e.g., with user interface 152).

On the other hand, as collapsible wall 100 reaches its fully collapsed state, controller 148 may use an input from collapsed state switch 166 (shown in FIG. 2 on top sill 158) to initiate deceleration and/or stop lift motor 118. Collapsed state switch 166 can be located on an exterior surface of top sill 158 and is electrically connected to controller 148. As shown in FIG. 6, collapsed state switch 166 contacts contact 167 as collapsible wall 100 reaches the fully collapsed state. Controller 148 can use an input from collapsed state switch 166 to determine when collapsible wall 100 has reached the fully collapsed state and to decelerate and/or stop lift motor 118 from continuing to wind lift cables 126 on lift cable drums 124. In other embodiments, a counter may be used to count a number of revolutions of drum shaft 125 before decelerating or stopping lift motor 118. The collapsed state deceleration for lift motor 118 can be set as a default in a memory of controller 148 or programmed in a memory of controller 148 after installation.

Other parameters for control of lift motor 118 can be set or programmed in a memory of controller 148. Such parameters can include target rates for lift motor 118 when raising or lowering bottom sill 110 or an acceleration for lift motor 118 to increase the rate of winding or unwinding of lift cables 126 when raising or lowering bottom sill 110. These parameters for control of lift motor 118 can be set as a default in a memory of controller 148 or programmed in a memory of controller 148 after installation.

In addition to motor assembly 116, closure mechanism assembly 134 is mounted on support frame 102. As shown in FIG. 1, closure mechanism assembly 134 includes closure motor 136, closure chain 137, and closure cable drum 138. In addition, and as shown in FIG. 2, closure mechanism assembly 134 further includes idler pulley 172 and torque limiter 176. As discussed in more detail below with reference to FIG. 2, controller 148 controls closure motor 136 so as to lock the panels in the first and second series of panels after lowering collapsible wall 100, and to unlock the panels in the first and second series of panels before raising collapsible wall 100.

Four linear actuators 156 are also mounted on support frame 102 and are used to extend biased seal members 160 and 161 outward from the edges of the panels in the first and second series of panels when collapsible wall 100 is in a fully extended state and the panels are locked. As described in more detail below with reference to FIGS. 14 and 15, each linear actuator 156 causes downward motion of a plunger which forces a biased seal member in a top panel to extend outward from the panel. The downward motion of the plunger in the top panel also causes a biased seal member in a panel below to extend outward from the panel. The extension of biased seal members continues down collapsible wall 100 until the last biased seal member 161 for the bottom panel extends down and outward.

Electronics 149 are also mounted on support frame 102 and can include, for example, transformers for supplying power to lift motor 118, closure motor 136, screw jack assemblies 146, linear actuators 156, or controller 148. In addition, cable reels 151 feed and retract cables that connect to electrical components located at or near bottom sill 110, such as floor contact sensor 144, extended state switch 121 shown in FIG. 2, or seal retraction sensor 281 shown in FIG. 16A. Cable reels 151 can be spring loaded to feed or retract slack in the cables as collapsible wall 100 is raised or lowered. In other embodiments, the position and number of cable reels 151 may vary from what is shown in FIG. 1.

The first series of panels is shown in FIG. 1 and includes panels 104 and bottom panel 109. The second series of panels includes panels 108 and bottom panel 111, which are opposite and substantially parallel to the first series of panels with collapsible wall 100 in the fully extended state as shown in the end view of FIG. 2. As appreciated by those of ordinary skill in the art, the number of panels in collapsible wall 100 is merely for illustration purposes and other embodiments may include a different number of panels.

Each panel in the first and second series of panels is pivotally connected to an adjacent panel. The adjacent panels can be hinged to each other at multiple locations along a length of the panels to approach uniform loading of top sill 158. The top panels in the first and second series of panels are pivotally connected to top sill 158 via hinges 244 shown in FIG. 6, which may also be located along a length of the top panels. Bottom panels 109 and 111 in the first and second series of panels, respectively, are pivotally connected to bottom sill 110 via hinges 112, which can be, for example, Soss-type hinges located along a length of the bottom panels.

As shown in FIG. 1, bottom panel 109 is taller than panels 104 above bottom panel 109. Similarly, bottom panel 111 in the second series of panels is longer than panels 108 above bottom panel 111. The extra length of bottom panels 109 and 111 allows for alignment of the panels in the first and second series of panels when in the fully collapsed state shown in FIG. 6. The lengths of bottom panels 109 and 111 are also sized so that bottom panels 109 and 111 reduce the size of any gaps that might otherwise appear between bottom sill 110 and each of bottom panels 109 and 111 when collapsible wall 100 is in the fully collapsed state. In some embodiments, bottom sill 110 nearly contacts bottom edges of bottom panels 109 and 111 when collapsible wall 100 is in a fully stored state. In such embodiments, bottom sill 110 can interlock with the bottom edges of bottom panels 109 and 111 using latches (not shown) when the first series and second series of panels are fully collapsed. Controller 148 may then unlatch the latches before lowering bottom sill 110.

As noted above, each pair of adjacent panels in the first series of panels forms an interlocking seal 105 when the panels are locked. Similarly, each pair of adjacent panels 108 in the second series of panels form an interlocking seal 105 as shown in FIG. 2. In addition to interlocking seals 105, bottom panels 109 and 111 form interlocking seals 107 with bottom sill 110, and the top panels 104 and 108 of the first and second series each form an interlocking seal 103 with top sill 158.

Each interlocking seal helps provide soundproofing between the spaces created on each side of collapsible wall 100. Biased seal members 160, 161, and bottom seals 154 can each further improve the soundproofing provided by collapsible wall 100. Such soundproofing can be especially useful for installations of collapsible wall 100 such as theaters or conference rooms, or where the desired sound levels differ for the spaces formed on opposite sides of collapsible wall 100.

As shown in FIG. 1, collapsible wall 100 includes first modular portion 140 and second modular portion 142 to facilitate assembly of collapsible wall 100 at the installation site. The components of first modular portion 140 and second modular portion 142 can be delivered to the installation site mostly assembled and with second modular portion 142 in a collapsed state.

First modular portion 140 includes support frame 102 and the components mounted on support frame 102. Second modular portion 142 includes the first and second series of panels together with top sill 158 and bottom sill 110.

During assembly, first modular portion 140 can be mounted to building structure 10 by connecting screw jack assemblies 146 (or fixed mounts) to building structure 10. With second modular portion 142 on building floor 20, lift cables 126 can be run through lifting sheaves 115 and 117 of lifting elements 114 and through pulleys 128 mounted on support frame 102. Motor assembly 116 can then be used to help raise second modular portion 142 toward first modular portion 140. With second modular portion 142 raised to first modular portion 140, support frame 102 of first modular portion 140 can be connected to top sill 158 of second modular portion 142 using mounting plates 106. Second modular portion 142 can then be lowered using motor assembly 116 to a fully extended state and closure cable 182 can be run through closure sheaves (i.e., sheaves 190, 192, 194 and 196 in FIG. 2) and closure mechanism assembly 134.

FIG. 2 depicts an end view of collapsible wall 100 in a fully extended state with its panels in a locked state according to an embodiment. As shown in FIG. 2, collapsible wall 100 includes cross braces 206, 208, 224 and 226 each pivotally coupled to panels in the first and second series of panels. The cross braces help ensure proper folding and unfolding of the panels by synchronizing the folding of opposite panels in the first and second series of panels. In addition, the cross braces can also support some of the weight of the panels when collapsible wall 100 is not in the fully extended and locked state. In the embodiment of FIG. 6, cross braces 206 and 208 support some of the weight of the panels by resting on rails 262 of bottom sill 110. The cross braces can also add to the rigidity of the first and second series of panels when collapsible wall 100 is in the fully extended and locked state. Other embodiments may have more or less cross braces depending upon the number of panels in the first and second series of panels.

Cross braces 206 and 208 are pivotally coupled to each other at center portions of the cross braces about pin 210. Each of cross braces 206 and 208 also include a slot 212 for allowing movement of pin 210 as collapsible wall 100 transitions between the fully extended and fully collapsed states. Pin 210 may be biased to a center position using springs (not shown) on an interior side of cross braces 206 and 208. Biasing pin 210 toward a center position can ordinarily reduce any unwanted lifting load on cross braces 206 and 208. In other embodiments, cross braces 224 and 226 may include slots for movement of pin 222 which may be biased toward a center portion. In yet other embodiments, cross braces 206 and 208 may not include slots 212 such that cross braces 206 and 208 pivot about a fixed pin 210.

Cross brace 206 is pivotally coupled on a bottom end portion to bottom panel 109 via connector 218. On a top end portion, cross brace 206 is pivotally coupled via connector 220 to a panel 108 adjacent bottom panel 111. Similarly, cross brace 208 is pivotally coupled on a bottom end portion to bottom panel 111 via connector 216. Cross brace 208 is also connected to a panel 104 adjacent bottom panel 109 via connector 214.

As shown in FIG. 2, cross braces 224 and 226 are pivotally coupled to each other at center portions of the cross braces about pin 222. In addition, cross brace 224 is pivotally coupled on a bottom end portion to a panel 108 in the second series of panels via connector 230. On a top end portion, cross brace 224 is pivotally coupled via connector 228 to the top panel 104 in the first series of panels. Similarly, cross brace 226 is pivotally coupled on a bottom end portion to a panel 104 in the first series of panels via connector 234. Cross brace 226 is also connected to the top panel 108 in the second series of panels via connector 232.

FIG. 2 also depicts closure sheaves 190, 192, 194 and 196 which are engaged with closure cable 182 and connected to panel hinges 198, 200, 202 and 204, respectively, which are mounted on an interior surface of panels 108. In addition to hinges 198, 200, 202, and 204, collapsible wall 100 also includes hinges 250 mounted between panels 108 and located at interlocking seals 105 without closure sheaves.

As discussed in more detail below, closure sheaves 190, 192, 194 and 196 are used to pull the panels via hinges 198, 200, 202 and 204 into a locked state after collapsible wall 100 has been fully extended or to unlock the panels before collapsing the panels. After extending collapsible wall 100, the panels are initially in an unlocked state as shown in FIG.

4. Closure cable 182 is pulled tight by closure mechanism assembly 134 to pull the panels laterally inward toward each other, thereby closing interlocking seals 105 between the panels and providing collapsible wall 100 with a flush appearance along the exterior surfaces of the first and second series of panels. As shown in FIG. 2, the closure sheaves are located at alternating interlocking seals 105 along the first and second series of panels. In addition, gas spring 223 can be used to assist the closing of the panels. Gas spring 223 can be mounted on opposing panels such as panels 104 and 108 with rotating joints 221 such that gas spring 223 pulls panels 104 and 108 inward toward each other.

Figure 4:
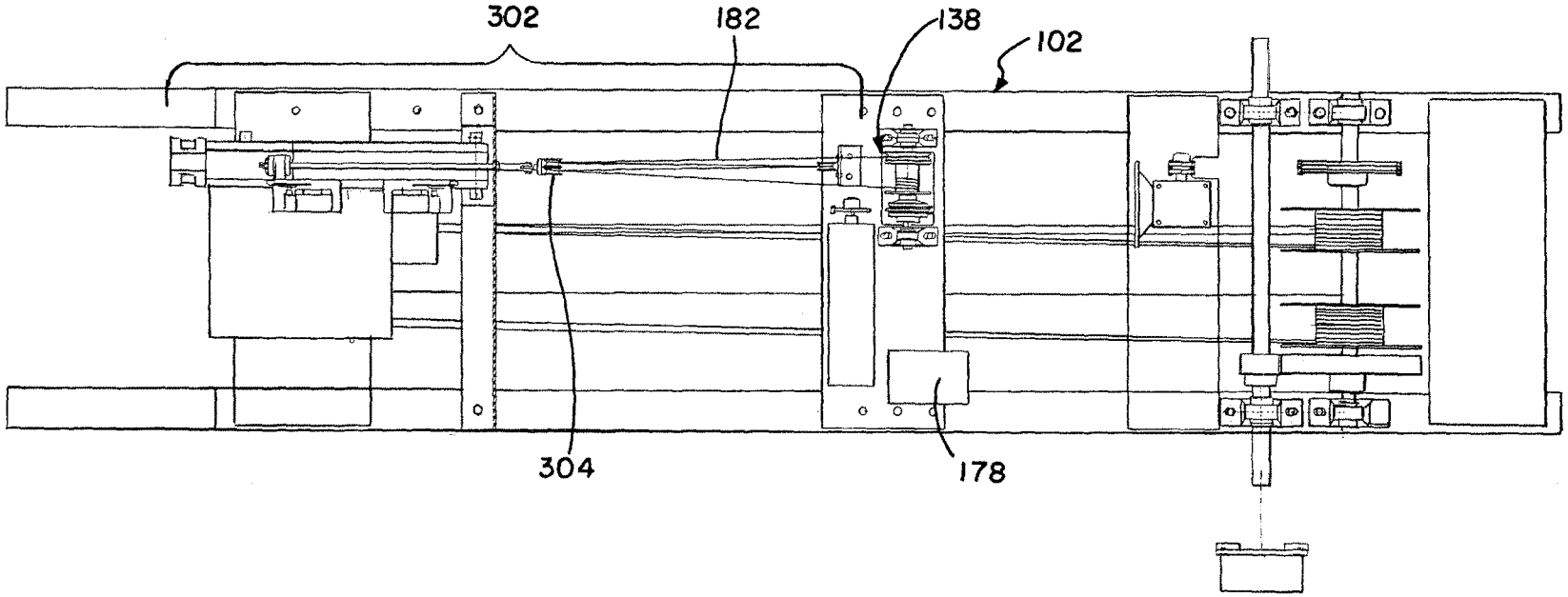
FIG. 4 depicts a partial top view of a support frame with a tension device for a closure cable according to an embodiment.
Figure 5A:
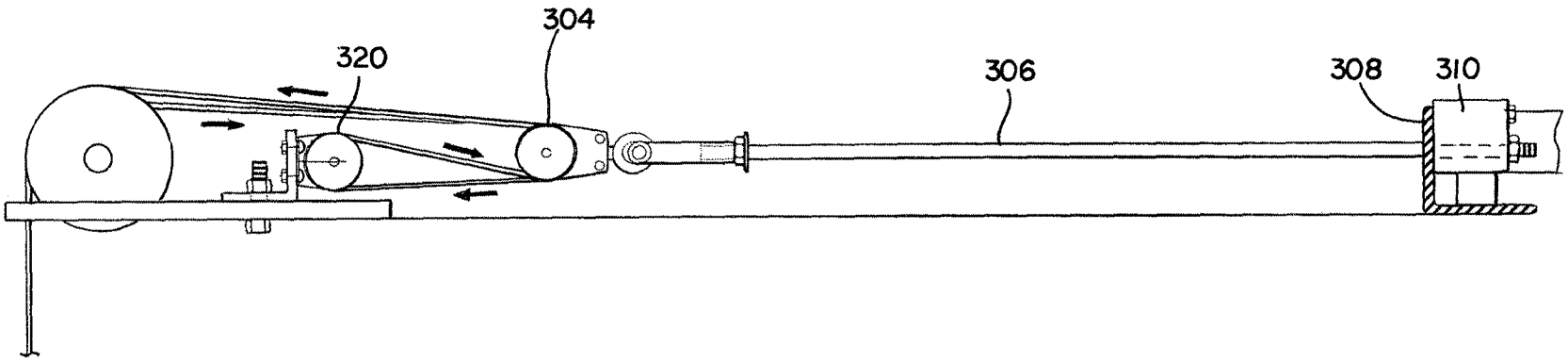
FIG. 5A depicts a side view of a connection configuration for the tension device of FIG. 4 according to an embodiment.

Closure cable 182 is pulled tight by winding closure cable 182 onto closure cable drum 138 using closure motor 136, which is controlled by controller 148. Closure mechanism assembly 134 also includes idler pulley 172 for feeding closure cable 182 to and from tension device 302 (shown in FIGS. 4 to 5C), and torque limiter 176 to protect against over-tensioning of closure cable 182. Closure cable 182 runs from closure cable drum 138 through tension device 302 as shown in FIGS. 4 and 5A. In addition, closure cable 182 also runs through sheaves 190, 192, 194 and 196 as shown in FIG. 2, and terminates at closure spring 178.

Figure 3:
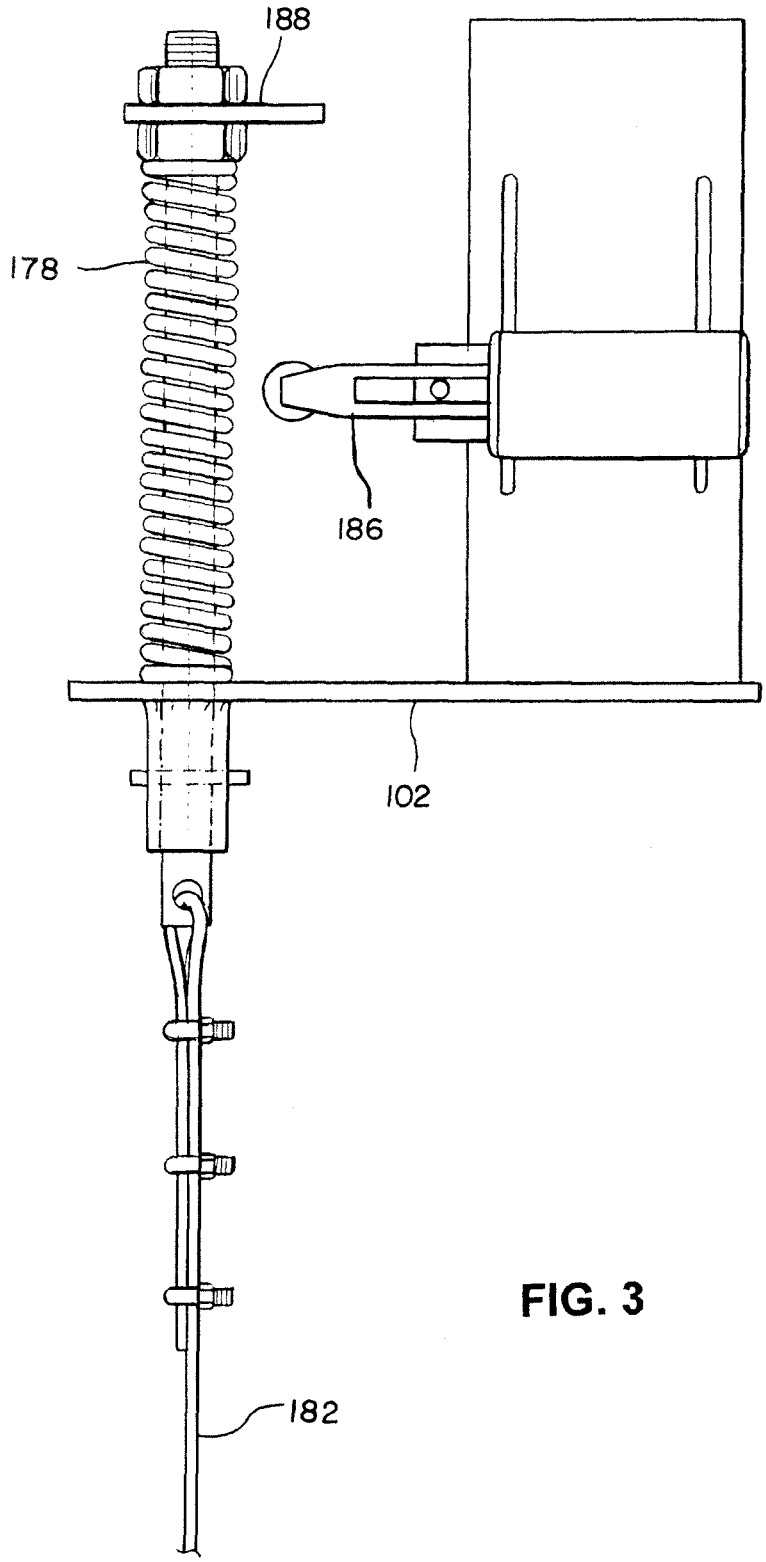
FIG. 3 depicts a portion of a closure mechanism according to an embodiment.

As shown in more detail in FIG. 3, high tension contact 188 is mounted on closure spring 178 so as to provide controller 148 an indication of a high tension level in closure cable 182. High tension contact 188 makes contact with high tension switch 186 when closure spring 178 is compressed by a high level of tension in closure cable 182. Such a high level of tension occurs when the panels of collapsible wall 100 are in a closing or locked state as shown in FIG. 2. In other embodiments, a low tension switch may also be included along a path of travel of high tension contact 188 to indicate a low level of tension in closure cable 182. In the example of FIG. 3, such a low tension switch can be positioned above high tension switch 186.

Figure 5B:
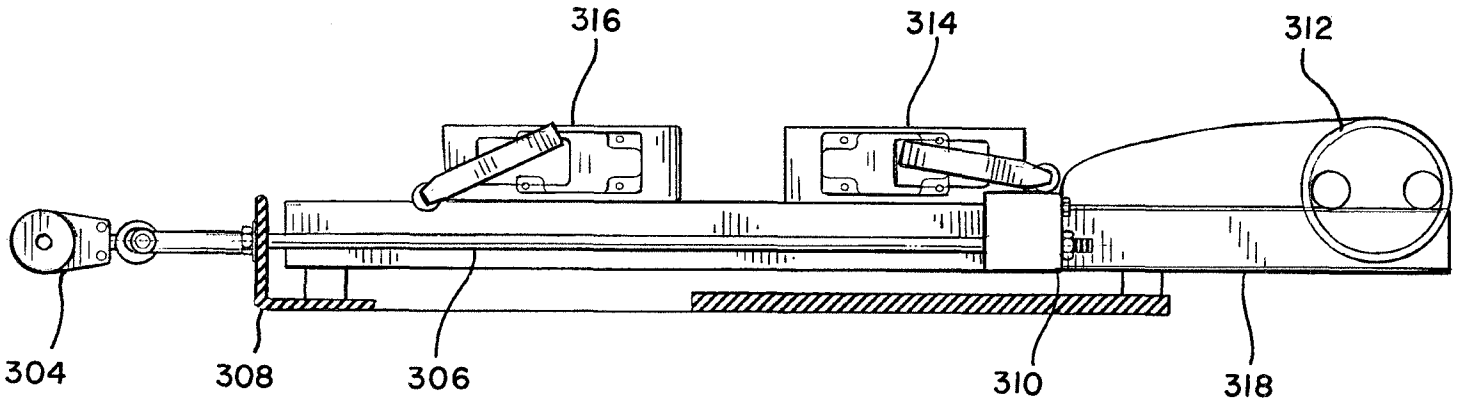
FIG. 5B depicts a side view of the tension device of FIG. 4 according to an embodiment.
Figure 5C:
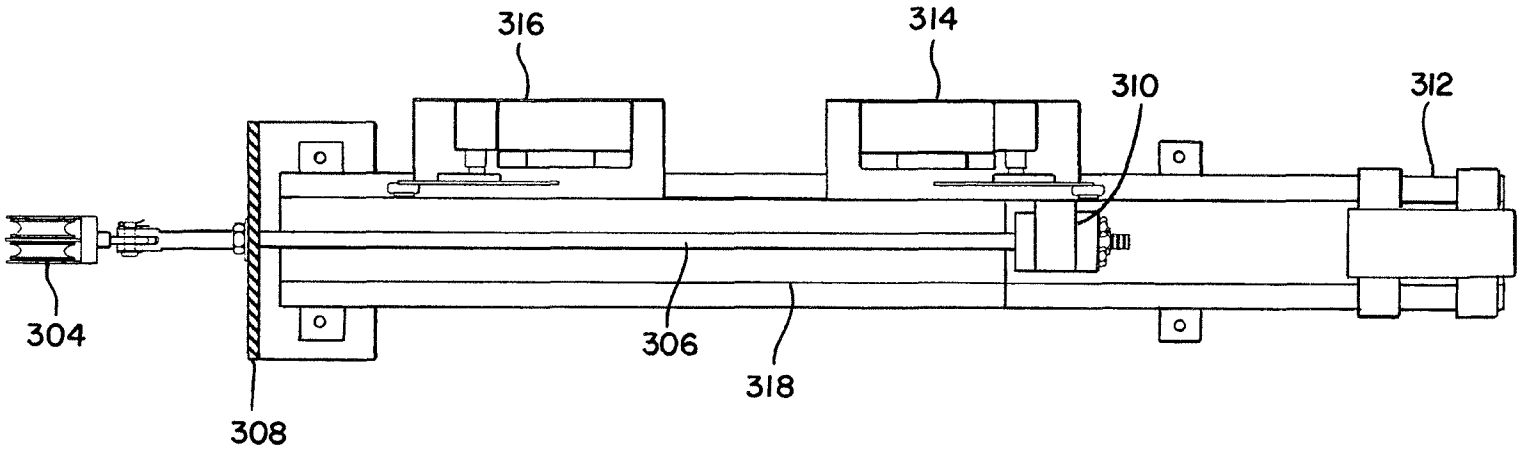
FIG. 5C depicts a top view of the tension device of FIG. 5B according to an embodiment.

FIGS. 4 to 5C provide detailed views of tension device 302 of closure mechanism assembly 134 according to an embodiment. Tension device 302 can regulate a tension level in closure cable 182 as the panels of collapsible wall 100 are extended or collapsed.

As panels are folded, the rate of travel and the tension level for closure cable 182 will vary. To compensate for this variation, the embodiment of FIGS. 4 to 5C includes tension device 302 including shuttle 310, tension switches 314 and 316, tension rod 306, closure stop 308, tension sheave 304, sheave 320, biasing element 312, and channel 318.

FIG. 4 depicts a partial top view of support frame 102 with tension device 302. As shown in FIG. 16, tension sheave 304 of tension device 302 is engaged with closure cable 182, which is wound on closure cable drum 138.

FIG. 5A provides a side view showing a connection configuration for tension device 302 according to an embodiment where tension device 302 is in a high tension state. As shown in FIG. 5A, tension sheave 304 is a double sheave that receives closure cable 182 from closure cable drum 138, feeds closure cable 182 to sheave 320, which is returned to tension sheave 304, and fed to idler pulley 172.

FIGS. 5B and 5C depict a side view and a top view, respectively, of tension device 302 according to an embodiment where tension device 302 is in a low tension state. In the embodiment of FIGS. 5B and 5C, tension device 302 regulates tension in closure cable 182 during extension and collapsing of the panels by allowing shuttle 310 to slide within channel 318 under tension from biasing element 312, which can be a constant force spring. In other words, shuttle 310 is configured to move in channel 318 based on a tension level in closure cable 182 with its movement biased by biasing element 312.

During operation, the distance between sheave 320 and tension sheave 304 will vary as the panels fold or unfold. Extending the panels from overhead storage involves closure motor 136 coiling closure cable 182. If during the coiling, shuttle 310 trips tension switch 314, controller 148 can cause closure motor 136 to cease operation since continued coiling can cause a high tension state in closure cable 182 that may prevent the panels from unfolding. Coiling by closure motor 136 can be restarted by controller 148 after a timed delay.

Retracting or lifting the panels from an extended state can involve closure motor 136 feeding closure cable 182 toward the panels. If during this operation, shuttle 310 trips tension switch 314, controller 148 can cause closure motor 136 to cease operation to ordinarily prevent closure cable backlash on closure cable drum 138. On the other hand, should shuttle 310 activate tension switch 316, controller 148 can cause lift motor 118 to temporarily cease operation for a predetermined delay to allow closure motor 136 to feed additional cable for folding the panels.

Tension switches 314 and 316 can also be used by controller 148 to indicate when to initiate operation of lift motor 118. In more detail, if an input from user interface 152 is a command to lower collapsible wall 100 from storage, controller 148 can initiate closure motor 136 to coil closure cable 182 and shuttle 310 will move toward tension switch 316. When shuttle 310 activates tension switch 316, controller 148 will initiate lift motor 118 operation and lift cables 126 will be unwound from lift cable drums 124. Controller 148 also stops closure motor 136 from coiling closure cable 182 when shuttle 310 triggers tension switch 316. Unfolding of the panels releases tension in closure cable 182 allowing biasing element 312 to pull shuttle 310 away from tension switch 316. This action will signal controller 148 to restart closure motor 136 and resume coiling closure cable 182.

If an input from user interface 152 is a command to raise collapsible wall 100 from the extended state, controller 148 can initiate closure motor 136 to begin feeding closure cable 182 and shuttle 310 will move toward tension switch 314. When shuttle 310 activates tension switch 314, controller 148 can initiate operation of lift motor 118 to wind lift cables 126 onto lift cable drums 124. Controller 148 also terminates the feeding of closure cable 182 when shuttle 310 triggers tension switch 316. The lifting and folding of the panels imparts tension to closure cable 182 and shuttle 310 is pulled away from tension switch 314. This action signals controller 148 to restart closure motor 136 and resume feeding closure cable 182.

High tension switch 186 (shown in FIG. 3) and tension switches 314 and 316 are electrically connected to controller 148 so that controller 148 can receive inputs from the switches indicating a tension level in closure cable 182. In operation, controller 148 may receive an input from user interface 152 to raise collapsible wall 100 when collapsible wall 100 is in its fully extended state with its panels locked. Controller 148 controls closure motor 136 to reduce tension of closure cable 182 until receiving an input from tension switch 314 indicating that closure cable 182 is under a low level of tension before controlling lift motor 118 to raise lifting elements 114 to collapse the panels.

The tension of closure cable 182 also remains low while lowering collapsible wall 100. To lower collapsible wall 100, controller 148 can control lift motor 118 to lower lifting elements 114 based on an input received from user interface 152 until receiving an input from floor contact sensor 144 indicating that bottom sill 110 has contacted building floor 20 or from extended state switch 121 indicating that collapsible wall 100 is fully extended. Controller 148 can then control closure motor 136 to increase tension in closure cable 182 to pull opposing panels in the first series and the second series laterally inward toward each other until receiving an input from high tension switch 186 to stop closure motor 136 from winding closure cable 182 onto closure cable drum 138. At this point, the panels should be interlocked to close interlocking seals 105 as shown in FIG. 2.

With reference to FIG. 2, the first series of panels are shown with a cross section view to illustrate the biased seal members 160 and 161 within the panels while an exterior view of the panels in the second series depicts compression devices 170 and provide further detail of interlocking seals 103 and 105 according to an embodiment. As shown in FIG. 2, interlocking seals 103 and 105 include tongue and groove interlocking astragals with acoustic seals to provide a tight seal for soundproofing along the panels. In one implementation, the acoustic seals used in interlocking seals 103 and 105 are fin-type acoustic seals.

Figure 7:
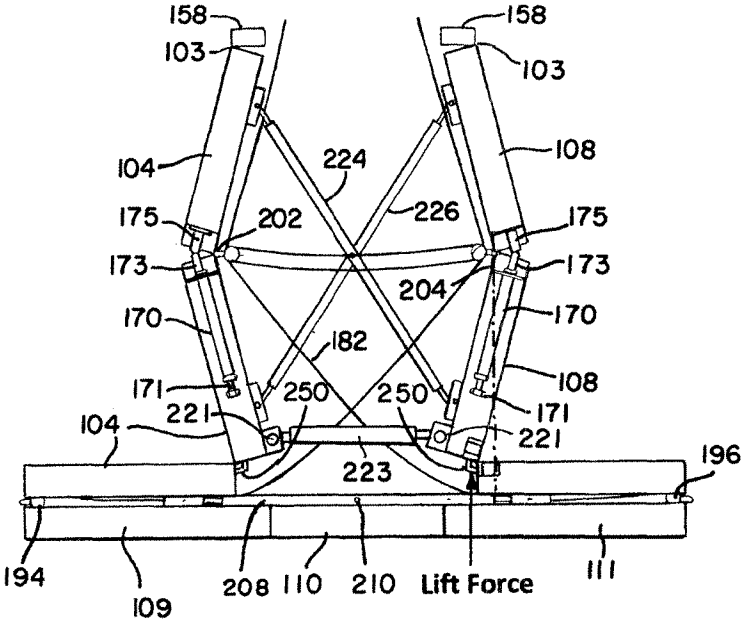
FIG. 7 depicts an end view of a collapsible wall in a partially collapsed state according to an embodiment.

Compression devices 170 are mounted on panels and located at alternating interlocking seals 105 along the first and second series of panels to bias the panels to collapse laterally outward from bottom sill 110. As shown in FIG. 7, each compression device 170 includes biased pushrod 173 which pushes on contact point 175 of an adjacent panel in the series. Compression device 170 can include an internal spring that can be adjusted by tightening spring adjustment 171 of compression device 170.

The cross section view of the first series of panels in FIG. 2 illustrates an arrangement of biased seal members 160 and 161 within panels 104 and 109, respectively. With biased seal members extended to substantially fill a gap between collapsible wall 100 and an adjacent wall or partition, soundproofing of collapsible wall 100 is ordinarily improved along the sides of the panels. In addition, and as shown in FIG. 2, biased seal members 160 overlap a top portion of the panel below when extended from the side edge of a panel. This overlap can serve to increase the rigidity of the first and second series of panels in the locked state.

In operation, linear actuator 156 moves plunger 162 down along a side edge of the top panel in the first series, which in turn, forces biased seal member 160 for the top panel to move out and down from the side edge of the top panel. For its part, the movement of biased seal member 160 for the top panel forces the biased seal member 160 for the next panel below to move out and down from the side edge of the panel. This downward motion, in turn, forces the next biased seal member 160 for the next panel down to move out and down from the side edge of the panel. Biased seal member 161 for bottom panel 111 is forced outward and down and includes an L-shaped bottom so as to fit into a space along bottom sill 110. In addition, seals 113 provide additional soundproofing at bottom sill 110. A more detailed description of an example implementation of biased seal members 160 and 161 is provided below with reference to FIGS. 16A to 17.

Figure 8:
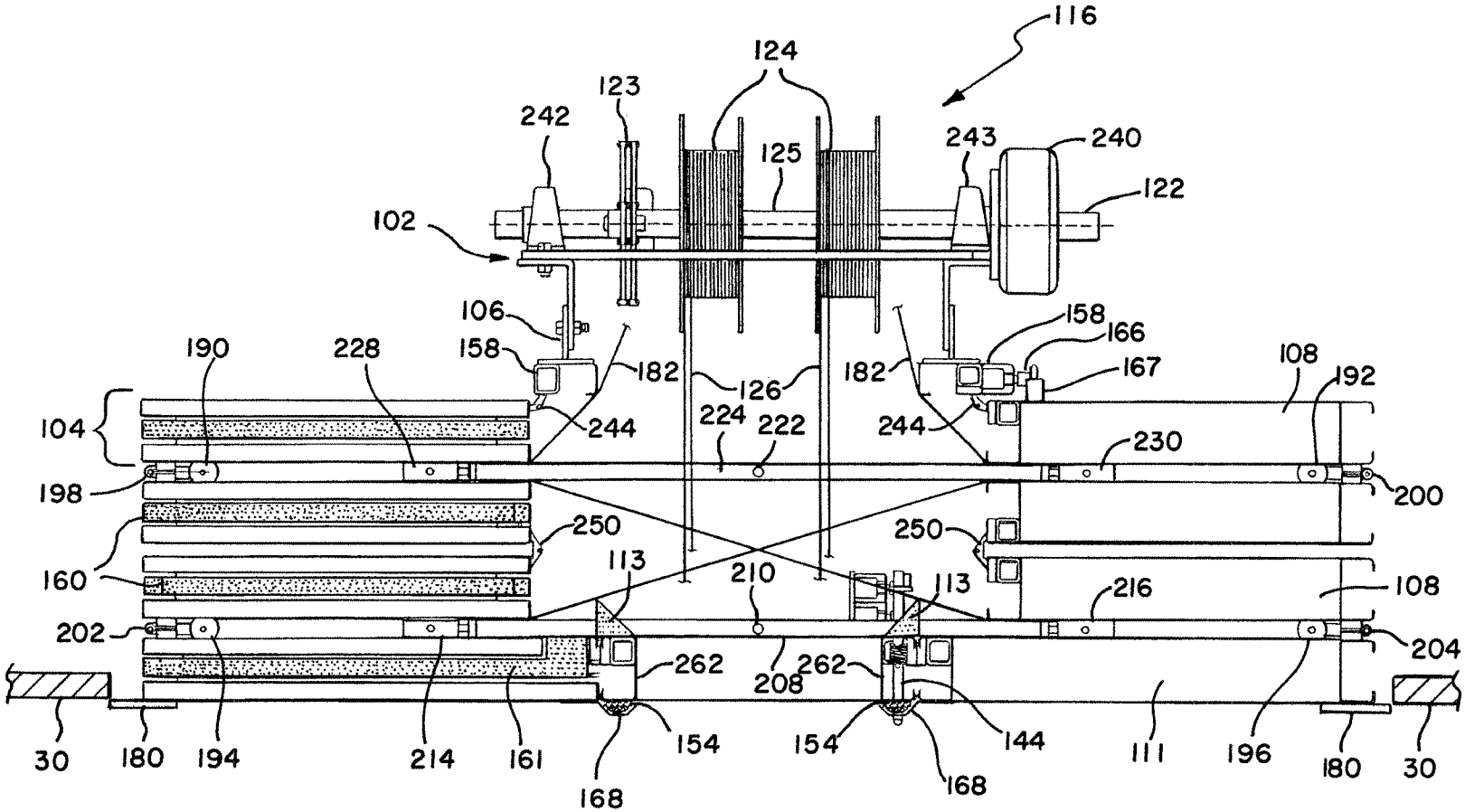
FIG. 8 depicts an end view of a collapsible wall in a fully collapsed state according to an embodiment.

Bottom covers 168 are positioned on exterior surfaces of bottom panels 109 and 111 to overhang from the bottom edges of the exterior surfaces. When collapsible wall 100 is in a fully collapsed state as shown in FIG. 8, bottom covers 168 cover at least a portion of gaps formed between bottom sill 110 and bottom panels 109 and 111. In the embodiment of FIG. 8, bottom covers 168 are also contoured to fit over bottom seals 154. In addition, and as shown in FIG. 8, bottom panels 109 and 111 can include top covers 180 positioned on the exterior surfaces of bottom panels 109 and 111 to cover at least a portion of gaps formed between the bottom panels and building ceiling 30. The use of covers 168 and 180 can ordinarily provide a more flush appearance with building ceiling 30 when collapsible wall 100 is in the fully collapsed state.

As shown in FIG. 2, bottom sill 110 includes rails 262 on opposite sides of bottom sill 110 and cross rail 254 between rails 262. Multiple cross rails 254 can be used to engage bottom sill 110 with lifting elements 114 as discussed in more detail below with reference to FIGS. 9 to 12.

FIG. 6 depicts an end view of collapsible wall 100 in a fully extended state with the first and second series of panels of the collapsible wall in an unlocked state. Collapsible wall 100 may be in such a state after lowering to building floor 20 or just before raising collapsible wall 100. As shown in FIG. 6, there is a low level of tension in closure cable 182 between opposing closure sheaves, which allows the panels to pivot about hinges 198, 200, 202, 204 and 250.

As bottom sill 110 is raised, the panels in the first and second series of panels sequentially fold up from bottom panels 109 and 111 toward the top panels as shown in FIG. 5. When bottom sill 110 is lowered, the panels in the first and second series of panels sequentially unfold down from the top panels toward bottom panels 109 and 111. As collapsible wall 100 is raised, the cross braces rotate from an extended state as shown for cross braces 224 and 226 to a collapsed state as shown by cross brace 208 with cross brace 206 located behind cross brace 208 in FIG. 7. In the collapsed state, cross braces 206 and 208 can partially support the weight of the panels above.

As shown by the dashed line in FIG. 7, compression device 170 positions hinge 204 so that it is orientated laterally outward from the lift force application point at hinge 250 shown by the upward arrow. This positioning of hinge 204 biases the panels connected to hinge 204 to fold laterally outward from bottom sill 110 when bottom sill 110 is raised by lifting elements 114.

FIG. 8 depicts an end view of collapsible wall 100 in a fully collapsed state according to an embodiment. As noted above, conventional partitions that slide or fold horizontally typically require additional floor space when stored. In contrast, collapsible wall 100 does not consume any floor space when stored since it is stored overhead.

In the embodiment of FIG. 8, support frame 102 is sufficiently mounted above building ceiling 30 or in a recess of building ceiling 30 so as to allow the first and second series of panels to substantially fit above building ceiling 30 when in the fully collapsed state. In addition, collapsible wall 100 is substantially flush with building ceiling 30 when in the fully collapsed state so as to provide a more aesthetic appearance when collapsible wall 100 is stored. In this regard, bottom covers 168 cover bottom seals 154 and can cover a portion of a gap formed between bottom sill 110 and the bottom panels. Top covers 180 cover a portion of a gap formed between the bottom panels and building ceiling 30.

Figure 9:
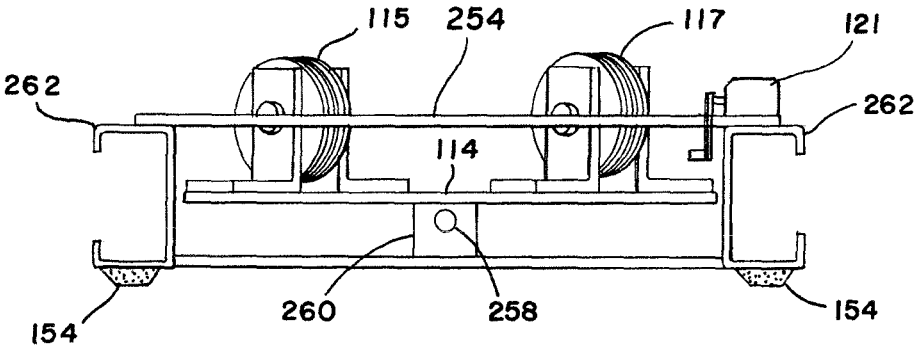
FIG. 9 depicts an end view of a bottom sill and a lifting element according to an embodiment.

FIG. 9 depicts an end view of bottom sill 110 and lifting element 114 in a lowered state where lifting element 114 is not bearing weight such as when collapsible wall 100 is in the fully extended state. As shown in FIG. 7, cross rail 254 is mounted on rails 262 so as to engage lifting element 114 when lifting element 114 is raised to bear weight. In the example of FIG. 9, extended state switch 121 is mounted on cross rail 254 so that a contact of extended state switch 121 contacts lifting element 114 when it is in a raised state. In other embodiments, extended state switch 121 can be mounted on rail 262.

As shown in FIG. 9, horizontal actuator sleeve 260 and pushrod 258 are positioned below lifting element 114 and are used to actuate a hinged side seal of collapsible wall 100, which is discussed in more detail below with reference to FIGS. 13 to 15.

Figure 11:
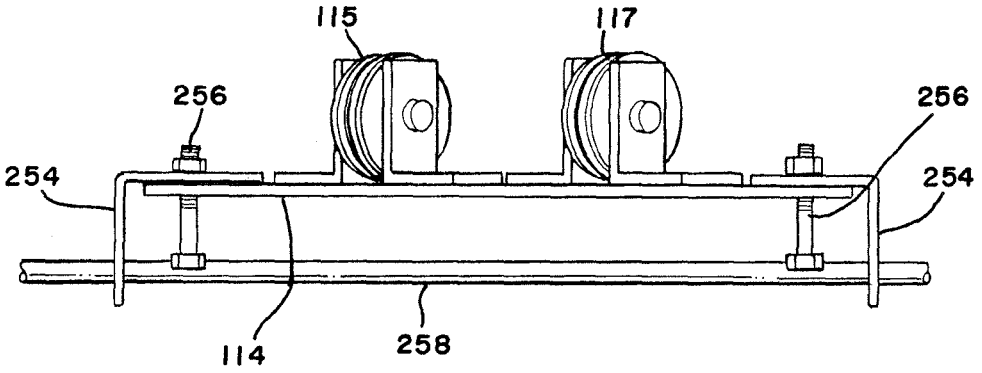
FIG. 11 depicts a side view of a bottom sill and a lifting element in a raised state according to another embodiment.

FIGS. 10 and 11 depict side views of bottom sill 110 with lifting element 114 in a lowered state and a raised state, respectively. As shown in FIGS. 10 and 11, lifting element 114 moves along guides 256 when transitioning between a non-weight bearing, lowered state and a weight bearing, raised state. Guides 256 are connected to cross rails 254 which come into contact with lifting element 114 when lifting element 114 is raised via lifting sheaves 115 and 117 as shown in FIG. 11.

Figure 12:
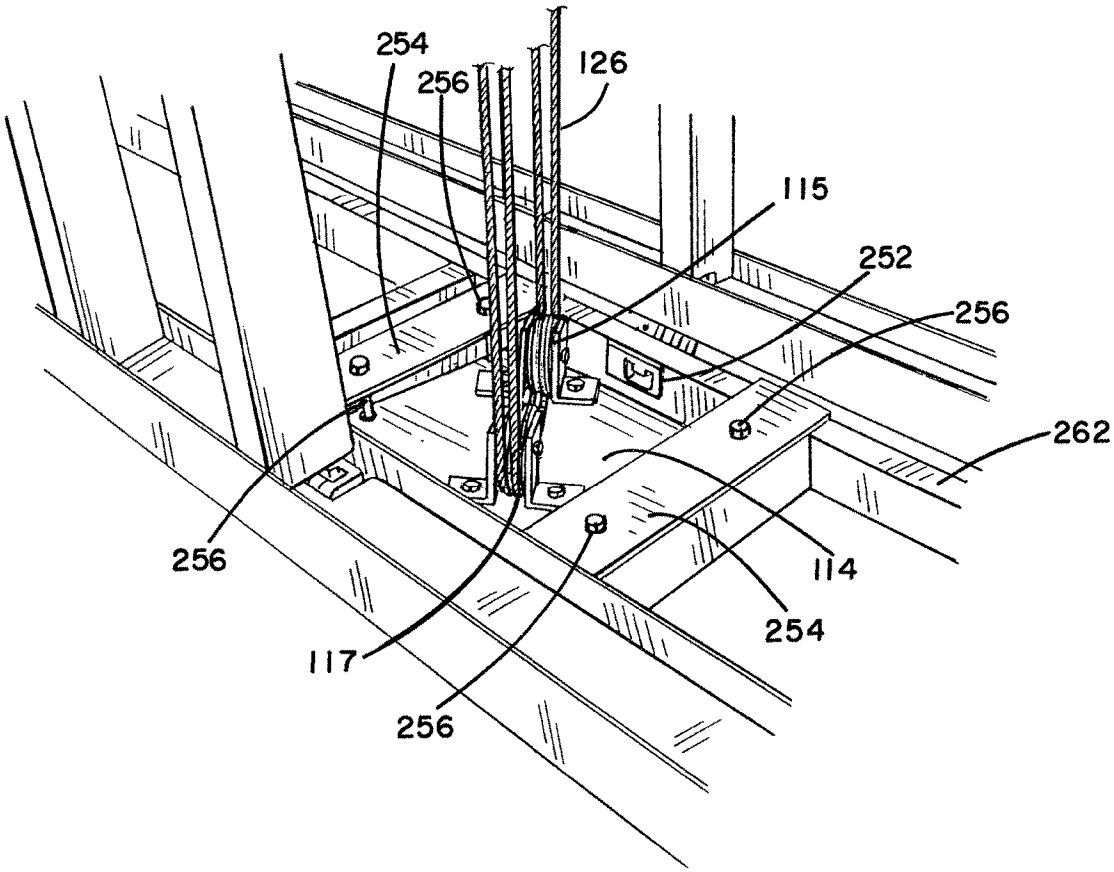
FIG. 12 depicts a perspective view of a lifting element and a bottom sill according to an embodiment.

FIG. 12 depicts a perspective view of lifting element 114 and bottom sill 110 with inner and exterior surfaces of the bottom panels removed to better illustrate lifting element 114 and bottom sill 110. As shown in FIG. 12, one or both of rails 262 of bottom sill 110 may include latching components that can engage lifting element 114 when bottom sill 110 is raised, and disengage from lifting element 114 when bottom sill 110 is fully lowered. Lifting element 114 is shown in FIG. 12 at a point where lift cables 126 have begun winding upon lift cable drums 124, but lifting element 114 has not fully engaged with bottom sill 110 as shown by lifting sheave 117 being pulled slightly higher than lifting sheave 115.

Figure 13:
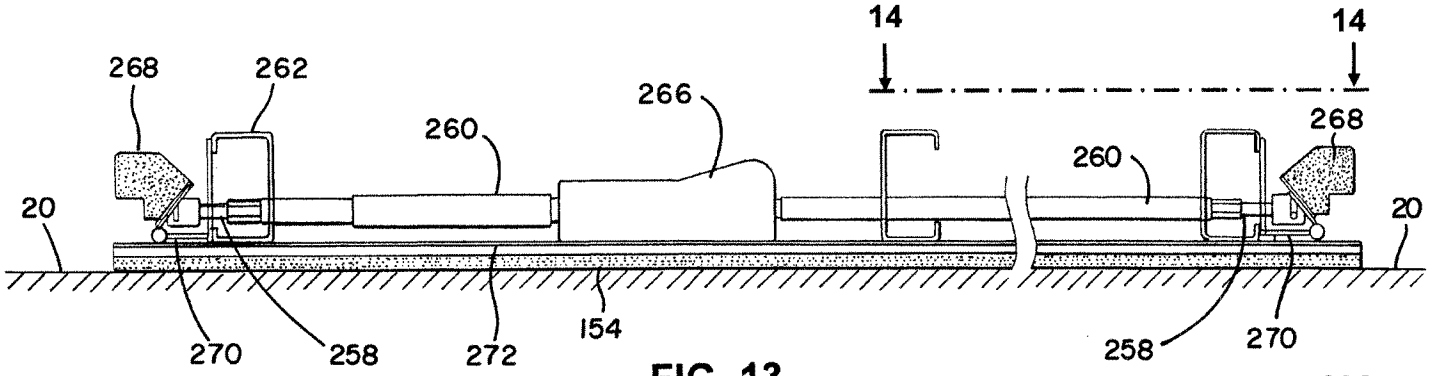
FIG. 13 depicts a side view of a horizontal actuator and hinged seals that have been retracted according to an embodiment.
Figure 14:
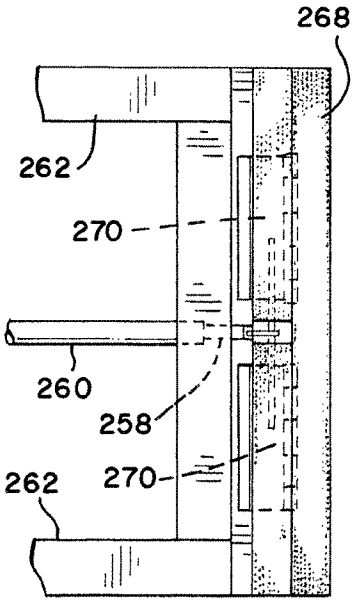
FIG. 14 depicts a top view of a hinged seal according to an embodiment.
Figure 15:
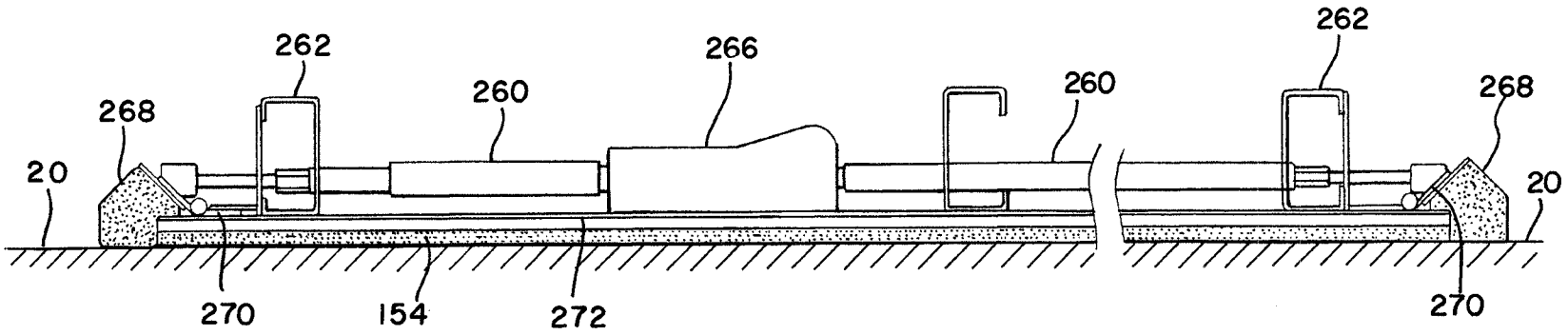
FIG. 15 depicts a side view of a horizontal actuator and hinged seals that have been extended according to an embodiment.

FIGS. 13 and 15 depict side views of horizontal actuator 266 and hinged side seals 268 according to an embodiment, and FIG. 14 provides a top view of a hinged side seal 268 along section line 14 in FIG. 13.

As shown in FIGS. 13 and 15, horizontal actuator 266 is mounted on bottom sill 110 above seal retainers 272 for bottom seals 154. Hinged side seals 268 are connected to hinges 270, which allow hinged side seals 268 to rotate away or toward building floor 20 in response to movement of pushrods 258. Pushrods 258 run through horizontal actuator sleeves 260 and connect to horizontal actuator 266. When collapsible wall 100 is fully extended, controller 148 controls horizontal actuator 266 to extend pushrods 258 away from horizontal actuator 266 to rotate hinged side seals 268 toward building floor 20 and provide additional soundproofing for collapsible wall 100 at bottom sill 110. FIG. 15 illustrates hinged side seals 268 in a sealed state after rotation toward building floor 20. As shown in FIG. 15, hinged side seals 268 are shaped so as to fit around seal retainers 272 and bottom seals 154. Hinged side seals 268 in the extended state can also contact biased seal members 161 to provide further soundproofing.

Before retracting collapsible wall 100, controller 148 controls horizontal actuator 266 to retract pushrods 258 toward horizontal actuator 266 and rotate hinged side seals away from building floor 20 to the position shown in FIG. 13.

Figure 16A:
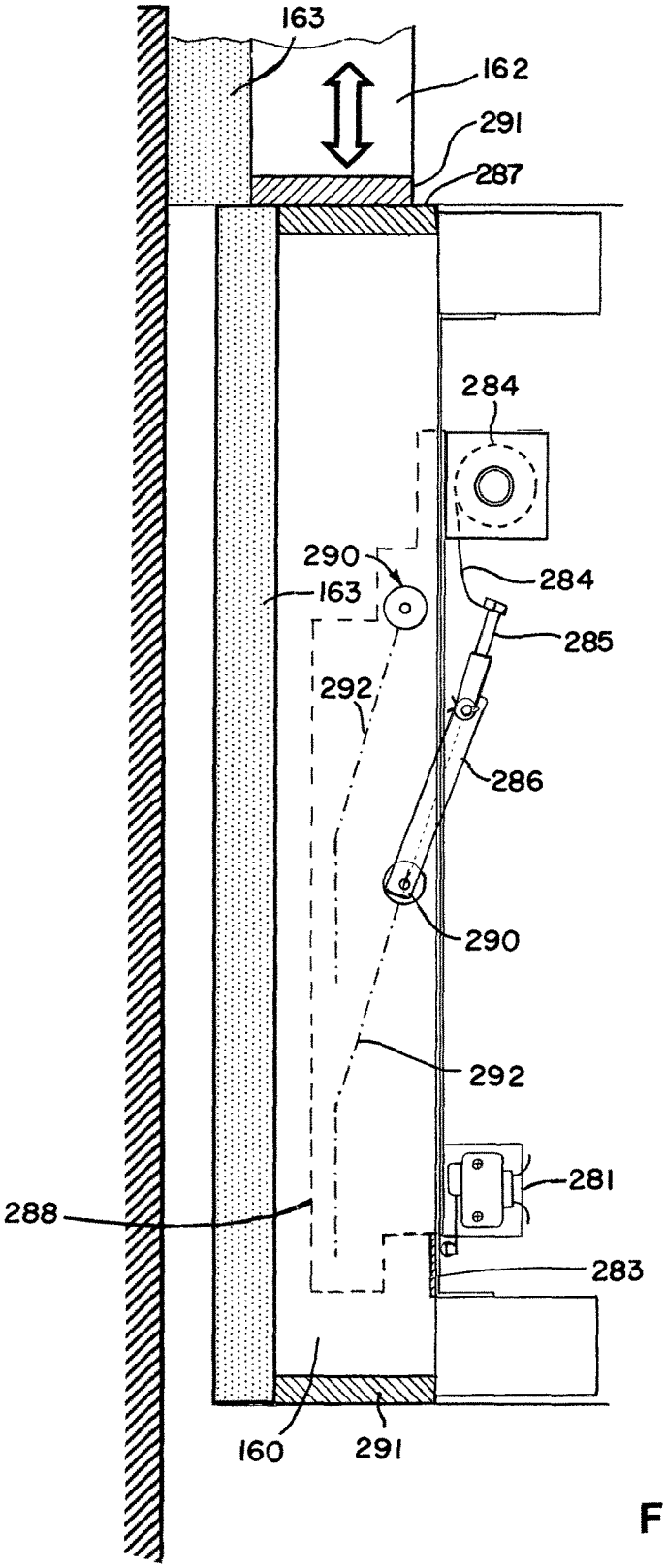
FIG. 16A depicts a side view of a panel with a biased seal member in a retracted state according to an embodiment.
Figure 16B:
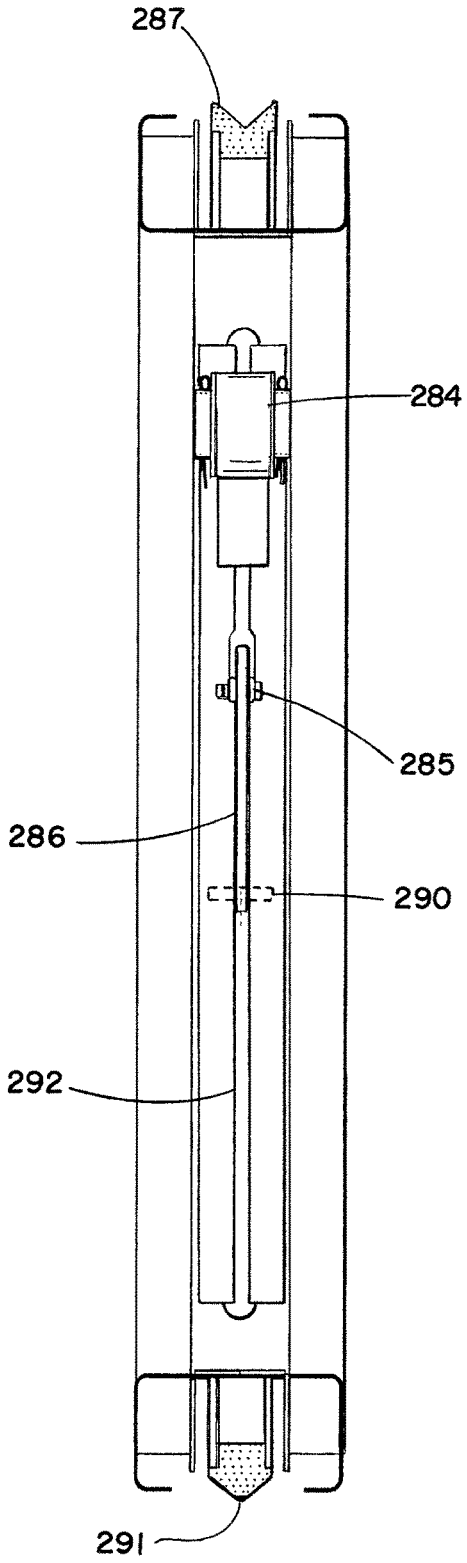
FIG. 16B depicts an interior end view of the panel of FIG. 16A according to an embodiment.
Figure 16C:
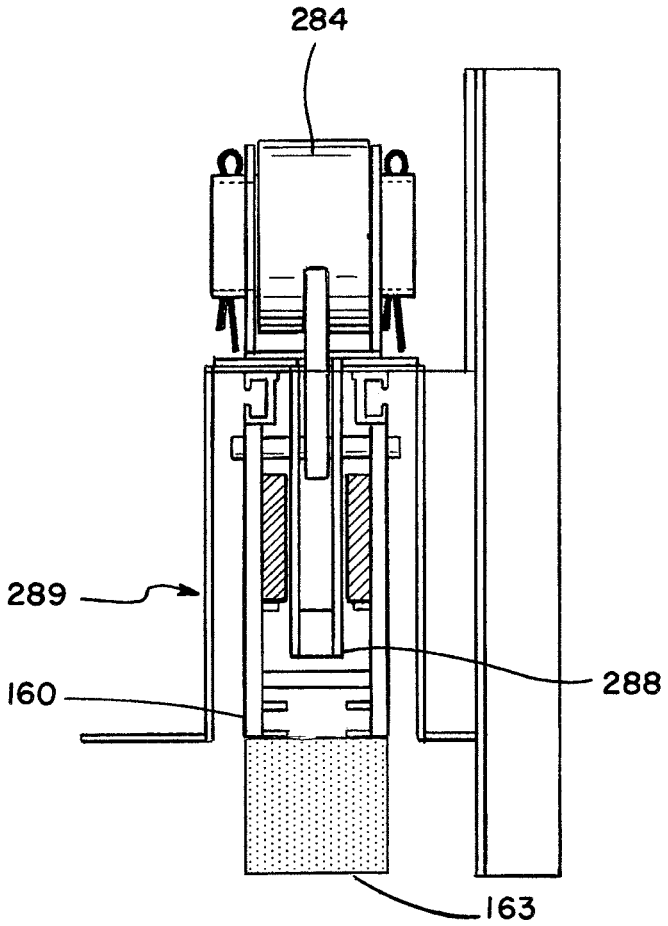
FIG. 16C depicts a top view of the panel of FIG. 16A according to an embodiment.

FIGS. 16A to 16C depict partially broken away views of a top panel to show a biased seal member 160 in a retracted state according to an embodiment. In addition, seals 163 are connected to top biased seal member 160 and plunger 162.

In the example of FIGS. 16A to 16C, guide pin 290 is attached to biased seal member 160 and also to connecting link 286 which is connected to spring 284 via connection 285. Guide pin 290 is configured to travel along slot 292 defined by internal guide element 288 as plunger 162 pushes seal member 160 downward with contact between interlocking end caps 287 and 291. A second slot 292 for a second pin 290 is also provided for each biased seal member 160 to reduce rotation of seal member 160 as it travels downward or upward. Internal guide element 288 is attached to seal case 289 and is located internal to seal member 160 and provides lateral stability as seal member 160 moves upward into the side edge of the panel or downward and out from the side edge of the panel.

Figure 17:
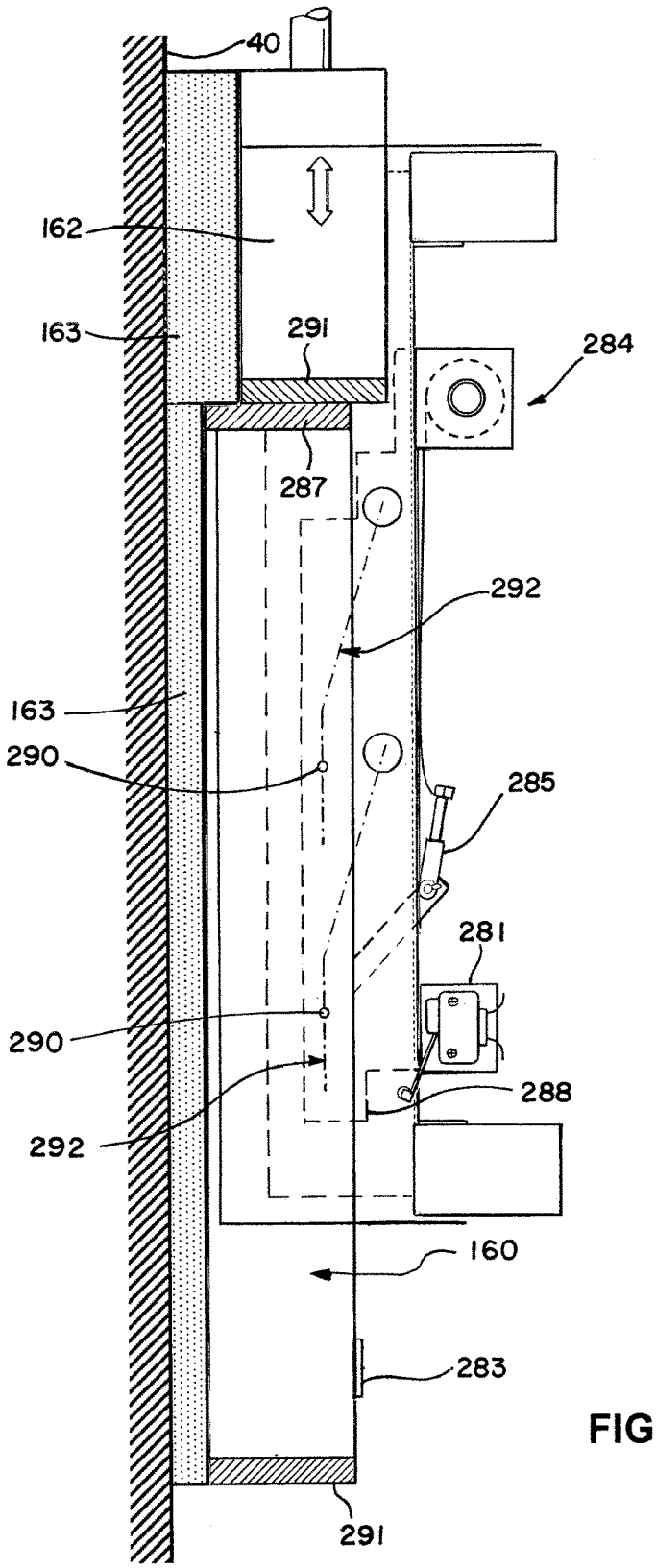
FIG. 17 depicts a side view of the panel of FIG. 16A with the biased seal member in an extended state according to an embodiment.

In the embodiment of FIGS. 16A to 16C, the arrangement for the top panel including biased seal member 160, slots 292, internal guide element 288, guide pins 290, connecting link 286 and spring 284 is provided for each panel that is adjacent to wall 40. Each of the panels in the first series and the second series of panels can have such an arrangement for extending and retracting biased seal members 160 and seals 163 toward and away from wall 40. Although wall 40 is depicted in FIGS. 16A to 17 as a building wall, wall 40 in other embodiments can include, for example, an adjacent partition or an adjacent collapsible wall such as collapsible wall 100.

As shown in FIG. 16A, seal retraction sensor 281 can be used to provide an indication to controller 148 of when seal member 160 is in a fully retracted state. Since seal members 160 overlap from one panel to the next in the extended state, the seal members 160 should be retracted before folding the panels. In the example of FIG. 16A, seal retraction sensor 281 includes a contact switch that is moved to a closed position when the retraction of seal member 160 causes strike plate 283 to contact a roller of seal retraction sensor 281. When seal member 160 is in an extended state, as shown in FIG. 17, seal retraction sensor 281 is in an open position. Other types of position sensors may be used for seal retraction sensor 281, such as magnetic, inductive, or optical proximity sensors.

In other embodiments, seal retraction sensor 218 may only be provided at a bottom panel since the retraction of seal members 160 occurs from the top panel to the bottom panel. If a bottom seal member is retracted, then the seal members above should also be retracted. Each of the four edges of collapsible wall 100 can include its own seal retraction sensor 281 at a bottom panel such that controller 148 only enables the collapsing of the panels or winding of lift cables 126 after each of the four seal retraction sensors 281 indicate that the seal members 160 have been retracted.

When collapsible wall 100 is in the fully extended state with locked panels, controller 148 commands linear actuator 156 to push plunger 162 downward so as to force seal member 160 downward and outward from the edge of the panel as guide pins 290 travel along slots 292. End cap 291 of seal member 160 in the topmost panel of the series will contact an interlocking end cap 287 of a seal member in the next panel down, thus forcing the seal member in that panel to travel downward and outward. The sequence continues until all seal members in the series have been extended and the bottom portion of seal member 161 contacts building floor 20.

FIG. 17 depicts the top biased seal member 160 having been pushed down by plunger 162 with seal 163 in contact with adjacent wall 40. As shown in FIG. 17, guide pins 290 have traveled down and out along slots 292 from their original position shown in FIGS. 16A to 16C. This action has caused seal member 160, which is guided by guide pins 290, to move down and out from the edge of the panel as shown in FIG. 17 to contact wall 40. The compression of seal 163 against wall 40 can allow seal 163 to conform to variances in the levelness of wall 40 and create a viable acoustic seal.

Figure 18:
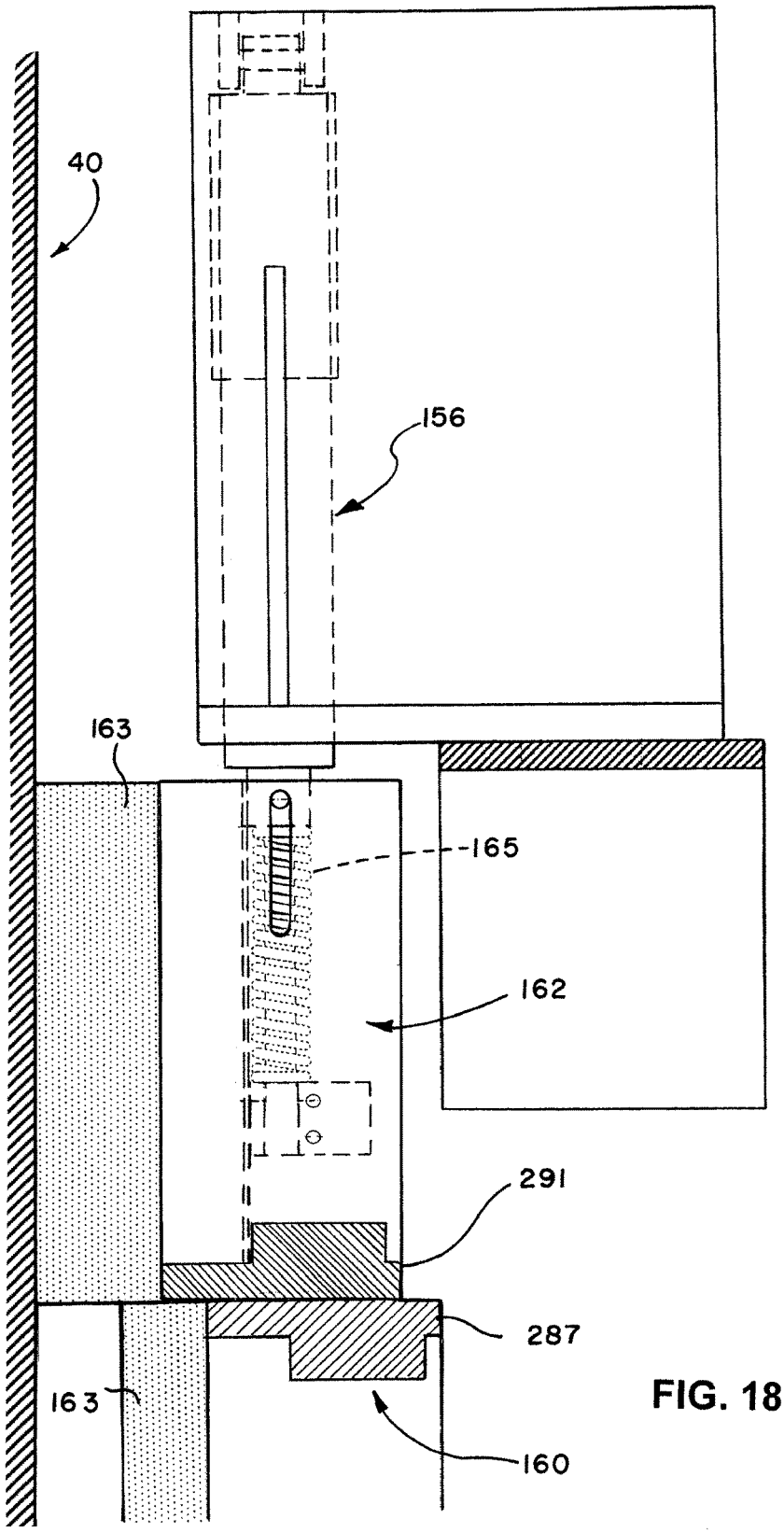
FIG. 18 depicts a side view of a connection between a linear actuator and a plunger according to an embodiment.

Although linear actuator 156 can have a fixed dimension of travel, the distance between building floor 20 and a bottom of panel 109 or 111 may vary due to building deflection, snow loads, wind loads, or other "live" loads. To compensate for this variation, plunger 162 can include spring connection 165 to linear actuator 156 as depicted in FIG. 18. A decrease in the distance between building floor 20 and the bottom of panel 109 or 111 will compress spring connection 165. When the distance between building floor 20 and the bottom of panel 109 or 111 increases, spring connection 165 will force seal members 160 downward to maintain contact with building floor 20.

In addition to the acoustic benefits of the arrangement shown in FIG. 15, this arrangement also improves the rigidity of wall 100 when it is in the fully extended and locked state due to the interlock of seal members 160 within adjacent panels.

When it is time to retract collapsible wall 100 from its extended state, controller 148 commands linear actuator 156 to retract plunger 162 back to the position as shown in FIGS. 16A to 16C. Springs 284 pull connecting links 286 so that guide pins 290 travel along slots 292. The force of springs 284 cause seal members 160 and 161 to retract as plunger 162 is retracted. With seal members 160 and 161 retracted into the panels, controller 148 can release tension in closure cable 182 to unlock the panels in preparation for winding of lift cables 126 to raise lifting element 114.

Figure 19:
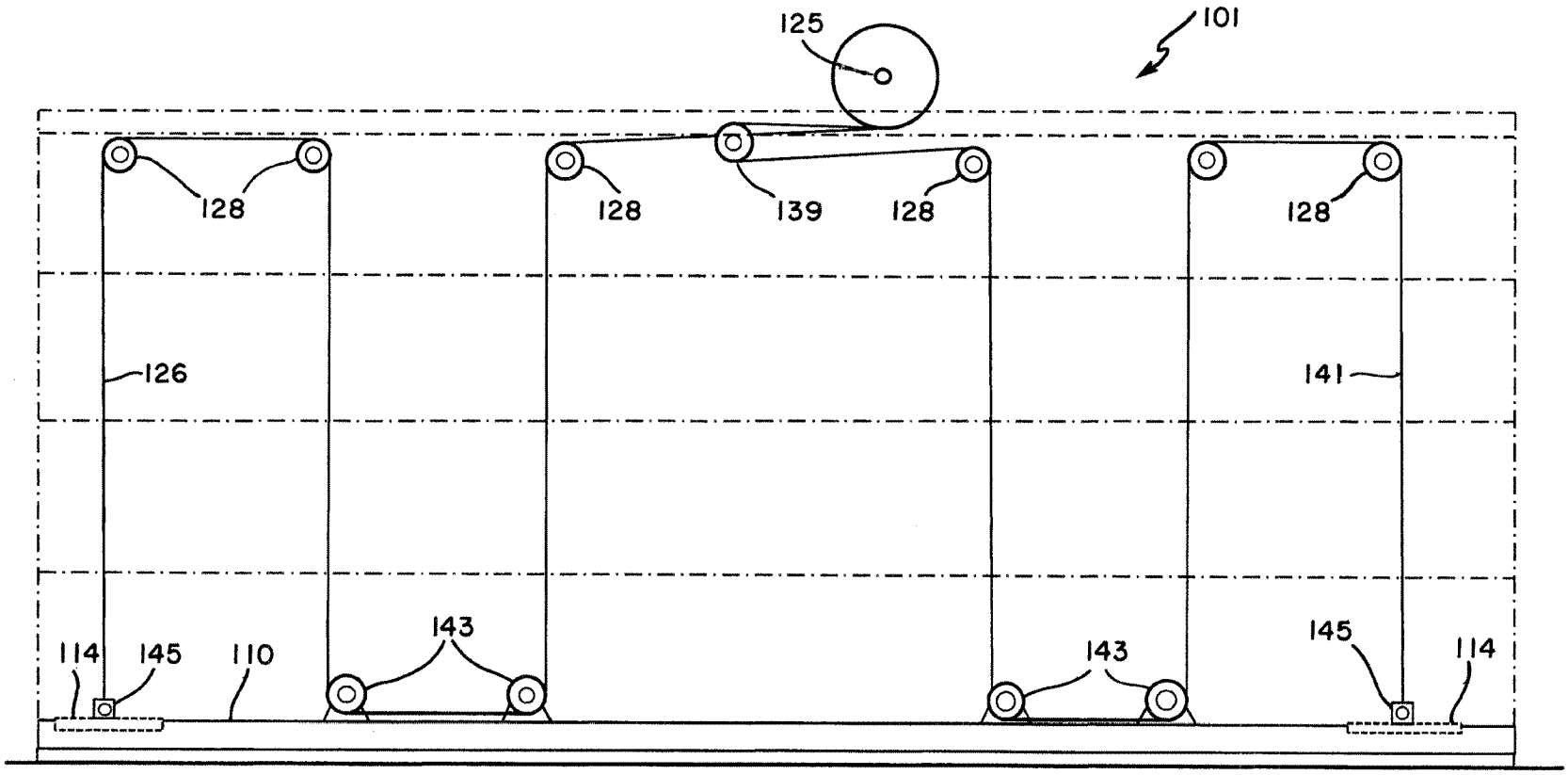
FIG. 19 illustrates a side view of an example lift cable routing according to an embodiment.
Figure 20:
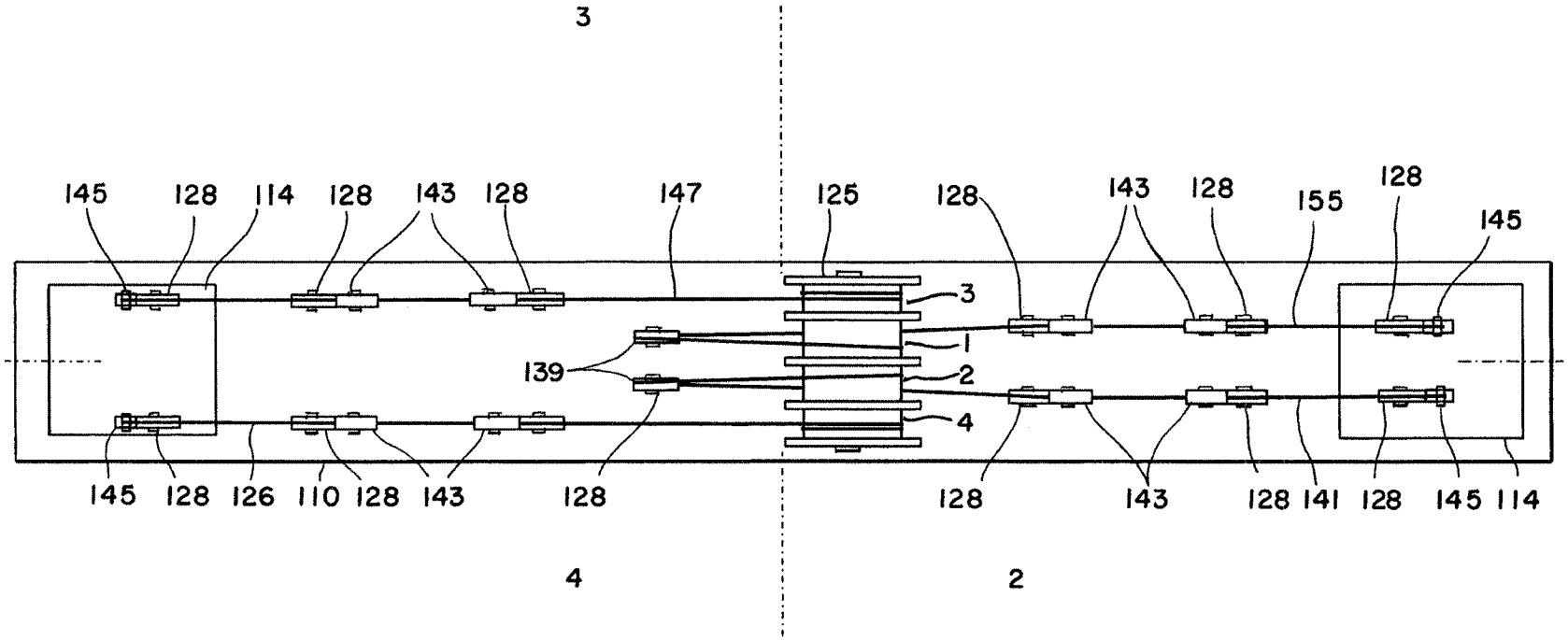
FIG. 20 illustrates a top view of the lift cable routing of FIG. 19 according to an embodiment.

As discussed above with reference to FIG. 1, alternative routings of lift cable 126 are possible to allow for a different load distribution. FIGS. 19 and 20 illustrate side and top views of an example lift cable routing according to an embodiment where four different lift cables 126, 141, 147, and 155 divide the load of the collapsible wall 101 into quadrants labeled 1, 2, 3, and 4 in FIG. 20. As shown in FIG. 20, each of the quadrants has its own lift cable that is routed from a corresponding lift cable drum labeled with 1, 2, 3, or 4 on the same drum shaft 125. Each quadrant has multiple lifting sheaves 143 acting as lifting elements for their respective quadrants. These multiple points of suspension ordinarily allow for a slower lift speed and reduced tension in each lift cable. The slower speed and reduced tension can allow for the use of a smaller motor (lower horsepower) to lift and lower collapsible wall 101.

In the example of FIGS. 19 and 20, lift cables 126 and 147 for quadrants 4 and 3, respectively, run to support pulleys 128 mounted on support frame 102. From there, lift cables 126 and 147 each run to two lifting sheaves 143 mounted on bottom sill 110, and back up to support pulleys 128 before being routed back down to lifting sheaves 143 mounted on a lifting plate 114. In comparison to the lift cable routing of FIG. 1, the lift cable routing of FIGS. 19 and 20 allows for a reduced load on the lift cables when lifting or lowering the same load due to the additional lifting sheaves 143 for collapsible wall 101.

Lift cables 155 and 141 for quadrants 1 and 2 follow a similar cable routing as for lift cables 126 and 147 described above, except that lift cables 155 and 141 first run to idler pulleys 139 to provide the appropriate lead angle for cable spooling onto lift cable drums 1 and 2.

The foregoing description of the disclosed example embodiments is provided to enable any person of ordinary skill in the art to make or use the embodiments in the present disclosure. Various modifications to these examples will be readily apparent to those of ordinary skill in the art, and the principles disclosed herein may be applied to other examples without departing from the spirit or scope of the present disclosure. The described embodiments are to be considered in all respects only as illustrative and not restrictive and the scope of the disclosure is, therefore, indicated by the following claims rather than by the foregoing description. All changes which come within the meaning and range of equivalency of the claims are to be embraced within their scope.

What is claimed is:

1. A collapsible wall, comprising:

a support frame constructed to suspend from a structure of a building;

a first series of panels configured to suspend from the support frame, the first series of panels including at least one pair of adjacent panels pivotally connected to each other;

a second series of panels configured to suspend from the support frame opposite the first series of panels, the second series of panels including at least one pair of adjacent panels pivotally connected to each other;

a bottom sill opposite the support frame and pivotally connected to a bottom portion of the first series of panels and to a bottom portion of the second series of panels;

at least one lifting element coupled to the support frame and arranged to lower the bottom sill;

a motor assembly mounted on the support frame and configured to lower the at least one lifting element so as to lower the bottom sill to extend the at least one pair of adjacent panels in the first series of panels vertically away from the support frame and extend the at least one pair of adjacent panels in the second series of panels vertically away from the support frame;

a closure mechanism mounted on the support frame;

a first hinge connected to a first pair of adjacent panels in the first series of panels with one end portion of the first hinge connected to a first panel of the first pair of adjacent panels and an opposite end portion of the first hinge connected to a second panel of the first pair of adjacent panels;

a second hinge connected to a second pair of adjacent panels in the second series of panels with one end portion of the second hinge connected to a first panel of the second pair of adjacent panels and an opposite end portion of the second hinge connected to a second panel of the second pair of adjacent panels;

a first sheave connected to the first hinge;

a second sheave connected to the second hinge; and a closure cable engaged with the closure mechanism, the first sheave, and the second sheave;

wherein the closure mechanism is configured to tighten the closure cable to pull the first pair of adjacent panels and the second pair of adjacent panels laterally inward toward each other when the collapsible wall is in a fully extended state.

2. The collapsible wall of claim 1, wherein a first modular portion for assembly of the collapsible wall includes the support frame and at least a portion of the motor assembly, and wherein a second modular portion for assembly of the collapsible wall includes the first series of panels, the second series of panels, and the bottom sill.

3. The collapsible wall of claim 1, further comprising:

a first cross brace pivotally coupled on one end portion of the first cross brace to a bottom panel in the first series of panels and pivotally coupled on an opposite end portion of the first cross brace to an adjacent panel pivotally coupled to a bottom panel in the second series of panels; and a second cross brace pivotally coupled on one end portion of the second cross brace to the bottom panel in the second series of panels and pivotally coupled on an opposite end portion of the second cross brace to an adjacent panel pivotally coupled to the bottom panel in the first series of panels, wherein the first cross brace and the second cross brace are pivotally coupled to each other at a center portion of the first cross brace and at a center portion of the second cross brace so as to synchronize extension of the bottom panels and the adjacent panels in the first series of panels and the second series of panels.

4. The collapsible wall of claim 1, further comprising a controller, and wherein the closure mechanism includes at least one switch electrically connected to the controller to indicate a tension level in the closure cable.

5. The collapsible wall of claim 1, wherein the closure mechanism further includes a tension device for regulating tension in the closure cable during extension of the at least one pair of adjacent panels in the first series of panels and extension of the at least one pair of adjacent panels in the second series of panels, the tension device including:

a tension sheave engaged with the closure cable;

a shuttle connected to the tension sheave and configured to move based on a tension level in the closure cable; and a biasing element configured to bias motion of the shuttle.

6. The collapsible wall of claim 1, further comprising:

a linear actuator mounted on the support frame;

a plunger positioned along a side edge of a panel in the first series of panels; and a biased seal member configured such that downward motion of the plunger caused by the linear actuator forces the seal member to move out from the side edge of the panel.

7. The collapsible wall of claim 1, further comprising:

at least one actuator mounted on the support frame and configured to connect the support frame to the structure of the building; and a controller electrically connected to the at least one actuator and configured to control the at least one actuator to raise or lower the support frame.

8. The collapsible wall of claim 7, wherein the at least one actuator includes a first screw jack assembly mounted on a first end portion of the support frame and a second screw jack assembly mounted on a second end portion of the support frame.

9. The collapsible wall of claim 7, further comprising a level sensor electrically connected to the controller, wherein the controller is further configured to control actuation of the at least one actuator based on an input received from the level sensor.

10. The collapsible wall of claim 7, further comprising a floor contact sensor electrically connected to the controller, wherein the controller is further configured to control actuation of the at least one actuator based on an input received from the floor contact sensor.

11. The collapsible wall of claim 1, wherein the at least one lifting element includes a plurality of lifting elements arranged to lower the bottom sill so as to distribute a load of the collapsible wall among the plurality of lifting elements when lowering the lifting element.

12. The collapsible wall of claim 1, further comprising:

an emergency brake coupled to the motor assembly;

a speed sensor indicating a rate of lowering of the bottom sill; and a controller configured to activate the emergency brake based on an input received from the speed sensor.

13. The collapsible wall of claim 1, further comprising a controller electrically connected to the motor assembly and configured to decelerate lowering of the bottom sill as the collapsible wall approaches a fully extended state.

14. The collapsible wall of claim 1, further comprising:

a horizontal actuator mounted on the bottom sill;

a pushrod connected to the horizontal actuator; and a hinged seal positioned near an edge of the bottom sill and connected to the pushrod such that actuation of the horizontal actuator rotates the hinged seal away or toward a floor of the building when the collapsible wall is in a fully extended state.

15. The collapsible wall of claim 1, further comprising a tongue and groove seal between the at least one pair of adjacent panels in the first series of panels.

16. The collapsible wall of claim 1, further comprising a cover positioned on an exterior surface of a bottom panel in the first series of panels such that the cover is positioned to overhang from a bottom edge of the exterior surface of the bottom panel so as to cover at least a portion of a gap formed between the bottom sill and the bottom panel when the collapsible wall is in a fully collapsed state.

17. The collapsible wall of claim 1, further comprising a cover positioned on an exterior surface of a bottom panel in the first series of panels such that the cover is positioned to overhang from a top edge of the exterior surface of the bottom panel so as to cover at least a portion of a gap formed between the bottom panel and a building ceiling when the collapsible wall is in a fully collapsed state.

18. A collapsible wall, comprising:

a support frame constructed to suspend from a structure of a building;

a first series of panels configured to suspend from the support frame, the first series of panels including at least one pair of adjacent panels pivotally connected to each other;

a second series of panels configured to suspend from the support frame opposite the first series of panels, the second series of panels including at least one pair of adjacent panels pivotally connected to each other;

a bottom sill opposite the support frame and pivotally connected to a bottom portion of the first series of panels and to a bottom portion of the second series of panels;

at least one lifting element coupled to the support frame and arranged to raise the bottom sill;

a motor assembly mounted on the support frame and configured to raise the at least one lifting element so as to raise the bottom sill to collapse the at least one pair of adjacent panels in the first series of panels vertically toward the support frame and collapse the at least one pair of adjacent panels in the second series of panels vertically toward the support frame; and at least one compression device including a biased pushrod, the compression device mounted on a first panel of a pair of adjacent panels in the first series of panels such that the biased pushrod contacts a second panel of the pair of adjacent panels so as to bias the pair of adjacent panels to collapse laterally outward away from the bottom sill.

19. The collapsible wall of claim 18, wherein a first modular portion for assembly of the collapsible wall includes the support frame and at least a portion of the motor assembly, and wherein a second modular portion for assembly of the collapsible wall includes the first series of panels, the second series of panels, and the bottom sill.

20. The collapsible wall of claim 18, further comprising:

a first cross brace pivotally coupled on one end portion of the first cross brace to a bottom panel in the first series of panels and pivotally coupled on an opposite end portion of the first cross brace to an adjacent panel pivotally coupled to a bottom panel in the second series of panels; and a second cross brace pivotally coupled on one end portion of the second cross brace to the bottom panel in the second series of panels and pivotally coupled on an opposite end portion of the second cross brace to an adjacent panel pivotally coupled to the bottom panel in the first series of panels, wherein the first cross brace and the second cross brace are pivotally coupled to each other at a center portion of the first cross brace and at a center portion of the second cross brace so as to synchronize collapsing of the bottom panels and the adjacent panels in the first series of panels and the second series of panels.

21. The collapsible wall of claim 18, further comprising:

a closure mechanism mounted on the support frame;

a first hinge connected to a first pair of adjacent panels in the first series of panels with one end portion of the first hinge connected to a first panel of the first pair of adjacent panels and an opposite end portion of the first hinge connected to a second panel of the first pair of adjacent panels;

a second hinge connected to a second pair of adjacent panels in the second series of panels with one end portion of the second hinge connected to a first panel of the second pair of adjacent panels and an opposite end portion of the second hinge connected to a second panel of the second pair of adjacent panels;

a first sheave connected to the first hinge;

a second sheave connected to the second hinge; and a closure cable engaged with the closure mechanism, the first sheave, and the second sheave;

wherein the closure mechanism is configured to loosen the closure cable to unlock the first pair of adjacent panels and the second pair of adjacent panels before collapsing the at least one pair of adjacent panels in the first series of panels and collapsing the at least one pair of adjacent panels in the second series of panels.

22. The collapsible wall of claim 21, further comprising a controller, and wherein the closure mechanism includes at least one switch electrically connected to the controller to indicate a tension level in the closure cable.

23. The collapsible wall of claim 21, wherein the closure mechanism further includes a tension device for regulating tension in the closure cable during collapsing of the at least one pair of adjacent panels in the first series of panels and collapsing of the at least one pair of adjacent panels in the second series of panels, the tension device including:

a tension sheave engaged with the closure cable;

a shuttle connected to the tension sheave and configured to move based on a tension level in the closure cable; and a biasing element configured to bias motion of the shuttle.

24. The collapsible wall of claim 18, further comprising:

a linear actuator mounted on the support frame;

a plunger positioned along a side edge of a panel in the first series of panels; and a biased seal member configured such that upward motion of the plunger caused by the linear actuator forces the seal member to move into the side edge of the panel.

25. The collapsible wall of claim 18, further comprising:

at least one actuator mounted on the support frame and configured to connect the support frame to the structure of the building; and a controller electrically connected to the at least one actuator and configured to control the at least one actuator to raise or lower the support frame.

26. The collapsible wall of claim 25, wherein the at least one actuator includes a first screw jack assembly mounted on a first end portion of the support frame and a second screw jack assembly mounted on a second end portion of the support frame.

27. The collapsible wall of claim 25, further comprising a level sensor electrically connected to the controller, wherein the controller is further configured to control the at least one actuator based on an input received from the level sensor.

28. The collapsible wall of claim 25, further comprising a floor contact sensor electrically connected to the controller, wherein the controller is further configured to control the at least one actuator based on an input received from the floor contact sensor.

29. The collapsible wall of claim 18, wherein the at least one lifting element includes a plurality of lifting elements arranged to raise the bottom sill so as to distribute a load of the collapsible wall among the plurality of lifting elements when raising the lifting element.

30. The collapsible wall of claim 18, further comprising:

an emergency brake coupled to the motor assembly;

a speed sensor indicating a rate of raising of the bottom sill; and a controller configured to activate the emergency brake based on an input received from the speed sensor.

31. The collapsible wall of claim 18, wherein the support frame is sufficiently mounted above a ceiling of the building so as to allow the panels in the first series of panels and the panels in the second series of panels to substantially fit above the ceiling when the collapsible wall is in a fully collapsed state.

32. The collapsible wall of claim 18, further comprising a controller electrically connected to the motor assembly and configured to control the motor assembly to decelerate raising of the bottom sill as the collapsible wall approaches a fully collapsed state.

33. The collapsible wall of claim 18, further comprising a tongue and groove seal between the at least one pair of adjacent panels in the first series of panels.

34. A collapsible wall, comprising:

a support frame configured to suspend from a structure of a building;

a first series of panels configured to suspend from the support frame, the first series of panels including at least one pair of adjacent panels pivotally connected to each other;

a second series of panels configured to suspend from the support frame opposite the first series of panels, the second series of panels including at least one pair of adjacent panels pivotally connected to each other;

a bottom sill pivotally connected to a bottom portion of the first series of panels and to a bottom portion of the second series of panels;

at least one lifting element in contact with the bottom sill;

a motor assembly configured to actuate the at least one lifting element so as to move the bottom sill relative to the support frame so as to laterally fold or laterally unfold the at least one pair of adjacent panels in the first series of panels and the at least one pair of adjacent panels in the second series of panels;

at least one actuator mounted on the support frame and configured to connect the support frame to the structure of the building; and a controller electrically connected to the at least one actuator and configured to control the at least one actuator to raise or lower the support frame.

35. A collapsible wall, comprising:

a support frame configured to suspend from a structure of a building;

a first series of panels configured to suspend from the support frame, the first series of panels including at least one pair of adjacent panels pivotally connected to each other;

a second series of panels configured to suspend from the support frame opposite the first series of panels, the second series of panels including at least one pair of adjacent panels pivotally connected to each other;

a bottom sill pivotally connected to a bottom portion of the first series of panels and to a bottom portion of the second series of panels;

at least one lifting element in contact with the bottom sill;

a motor assembly configured to actuate the at least one lifting element so as to move the bottom sill relative to the support frame so as to laterally fold or laterally unfold the at least one pair of adjacent panels in the first series of panels and the at least one pair of adjacent panels in the second series of panels;

a first cross brace pivotally coupled on one end portion of the first cross brace to a bottom panel in the first series of panels and pivotally coupled on an opposite end portion of the first cross brace to an adjacent panel pivotally coupled to a bottom panel in the second series of panels; and a second cross brace pivotally coupled on one end portion of the second cross brace to the bottom panel in the second series of panels and pivotally coupled on an opposite end portion of the second cross brace to an adjacent panel pivotally coupled to the bottom panel in the first series of panels, wherein the first cross brace and the second cross brace are pivotally coupled to each other at a center portion of the first cross brace and at a center portion of the second cross brace so as to synchronize lateral folding or lateral unfolding of the bottom panels and the adjacent panels in the first series of panels and the second series of panels.

36. A collapsible wall, comprising:

a support frame constructed to suspend from a structure of a building;

a first series of panels configured to suspend from the support frame, the first series of panels including at least one pair of adjacent panels pivotally connected to each other;

a second series of panels configured to suspend from the support frame opposite the first series of panels, the second series of panels including at least one pair of adjacent panels pivotally connected to each other;

a bottom sill opposite the support frame and pivotally connected to a bottom portion of the first series of panels and to a bottom portion of the second series of panels;

at least one lifting element coupled to the support frame and arranged to lower the bottom sill;

a motor assembly mounted on the support frame and configured to lower the at least one lifting element so as to lower the bottom sill to extend the at least one pair of adjacent panels in the first series of panels vertically away from the support frame and extend the at least one pair of adjacent panels in the second series of panels vertically away from the support frame;

a horizontal actuator mounted on the bottom sill;

a pushrod connected to the horizontal actuator; and a hinged seal positioned near an edge of the bottom sill and connected to the pushrod such that actuation of the horizontal actuator rotates the hinged seal away or toward a floor of the building when the collapsible wall is in a fully extended state.

* * * * *